US007866476B2

(12) United States Patent
McGonagle et al.

(10) Patent No.: US 7,866,476 B2
(45) Date of Patent: Jan. 11, 2011

(54) MULTI-DOSE BLISTER CARD PILLBOOK

(75) Inventors: Sean McGonagle, Buffalo Grove, IL (US); Greg Pankow, Morton Grove, IL (US); Christina M. Marotta, Chicago, IL (US); Amy C. Biesenthal, Buffalo Grove, IL (US); William H. Valls, Loveland, OH (US); Zack Simmering, Mansfield, OH (US)

(73) Assignee: Walgreen Co., Deerfield, IL (US)

( * ) Notice: Subject to any disclaimer, the term of this patent is extended or adjusted under 35 U.S.C. 154(b) by 0 days.

(21) Appl. No.: 12/130,365

(22) Filed: May 30, 2008

(65) Prior Publication Data

US 2009/0139893 A1 Jun. 4, 2009

Related U.S. Application Data

(60) Provisional application No. 60/940,790, filed on May 30, 2007, provisional application No. 60/947,169, filed on Jun. 29, 2007, provisional application No. 61/029,751, filed on Feb. 19, 2008.

(51) Int. Cl.
*B65D 83/04* (2006.01)

(52) U.S. Cl. ..... 206/535; 206/528; 206/538; 206/472; 206/473

(58) Field of Classification Search ..... 206/528, 206/535, 472, 473, 806, 539, 531, 532; 402/4, 402/64, 68, 73, 70, 504, 501; 211/50
See application file for complete search history.

(56) References Cited

U.S. PATENT DOCUMENTS 3,069,273 A 12/1962 Wayne
3,283,885 A * 11/1966 Grunewald et al. ..... 206/532
3,305,077 A 2/1967 Grief et al.
3,324,995 A 6/1967 Sharp, Jr.
3,351,192 A 11/1967 La Plante
3,503,493 A * 3/1970 Nagy ..... 206/232
3,529,718 A * 9/1970 Zaremski ..... 206/469
3,659,706 A 5/1972 Serrell
3,737,029 A * 6/1973 Serrell et al. ..... 206/461

(Continued)

FOREIGN PATENT DOCUMENTS

CA 2 629 458 A1 10/2009

(Continued)

OTHER PUBLICATIONS

Dispill systeme de distribution de medicaments, "Pour Les Pharmaciens," Retrieved from the Internet on Oct. 8, 2008. URL:http://www.dispill.com/plateaux.html.

(Continued)

*Primary Examiner*—David T Fidei
(74) *Attorney, Agent, or Firm*—Francis C. Kowalik, Walgreen Co.; Marshall, Gerstein & Borun LLP

(57) ABSTRACT

A product package includes a spine, a plurality of blister cards, and a coupler mechanism. Each blister card includes a plurality of individual cells. Each individual cell includes a blister for containing at least one product. The coupler mechanism is attached to the spine and re-attachably couples the plurality of blister cards within the product package.

29 Claims, 24 Drawing Sheets

U.S. PATENT DOCUMENTS 3,743,084 A * 7/1973 Douglas ..... 206/532
3,780,856 A 12/1973 Braverman
3,809,221 A 5/1974 Compere
3,817,393 A * 6/1974 Neilsen ..... 211/50
3,856,144 A 12/1974 Kelly
3,924,748 A 12/1975 Braverman
4,120,399 A 10/1978 Clarke
4,192,425 A * 3/1980 Landau et al. ..... 211/50
4,196,809 A 4/1980 Tonrey
4,211,329 A 7/1980 Braverman
4,295,567 A 10/1981 Knudsen et al.
4,305,502 A 12/1981 Gregory et al.
4,340,141 A 7/1982 Fischer
4,364,549 A 12/1982 Komossa et al.
4,428,709 A 1/1984 Peters
4,437,579 A 3/1984 Obland
4,673,086 A * 6/1987 Braverman et al. ..... 206/538
4,790,440 A * 12/1988 Leszczak ..... 211/11
4,844,246 A 7/1989 Harrison et al.
4,860,899 A 8/1989 McKee
4,889,236 A 12/1989 Bartell et al.
4,889,238 A * 12/1989 Batchelor ..... 206/535
4,909,414 A 3/1990 Heath
4,955,481 A 9/1990 Novinski et al.
4,975,015 A 12/1990 Harding
5,009,894 A 4/1991 Hsiao
5,014,851 A 5/1991 Wick
5,050,739 A 9/1991 Hannan et al.
5,265,728 A 11/1993 Allendorf et al.
5,323,907 A 6/1994 Kalvelage
5,377,836 A 1/1995 Eisenbraun
5,390,796 A 2/1995 Kerfoot, Jr.
5,431,283 A 7/1995 Weinstein et al.
5,460,471 A 10/1995 Connor et al.
5,509,773 A 4/1996 Connor et al.
5,515,972 A * 5/1996 Shames ..... 206/425
5,549,204 A 8/1996 Toren et al.
5,564,593 A 10/1996 East, Sr.
RE35,445 E 2/1997 Pora
5,685,420 A 11/1997 Martin et al.
5,720,384 A * 2/1998 Wu-Chen ..... 206/308.1
5,740,717 A 4/1998 Sowden et al.
5,775,505 A 7/1998 Vasquez et al.
5,788,079 A 8/1998 Bouthiette et al.
5,836,615 A * 11/1998 Elliot et al. ..... 281/21.1
5,915,559 A 6/1999 Hulick et al.
5,954,202 A 9/1999 Mellon
6,021,623 A 2/2000 Bouthiette et al.
6,023,916 A 2/2000 Bouthiette et al.
6,024,222 A 2/2000 Friberg et al.
6,024,247 A 2/2000 Birr et al.
6,155,423 A 12/2000 Katzner et al.
6,206,233 B1 3/2001 Schulze
6,219,997 B1 4/2001 Friberg et al.
6,244,462 B1 6/2001 Ehrensvard et al.
6,318,051 B1 11/2001 Preiss et al.
6,349,831 B1 2/2002 Buss
6,382,412 B1 5/2002 Wood
6,382,420 B1 5/2002 Bouthiette et al.
6,412,636 B1 7/2002 Jones et al.
6,491,211 B1 12/2002 Evans et al.
6,543,616 B1 4/2003 Peterson
6,550,618 B2 4/2003 Peterson
6,557,740 B1 5/2003 Dent
6,628,199 B1 9/2003 Ehrensvard et al.
6,652,215 B1 11/2003 Parker et al.
6,679,376 B2 * 1/2004 Chen ..... 206/308.1
6,681,935 B1 1/2004 Lewis
6,698,425 B1 3/2004 Widerstrom et al.
6,708,826 B1 * 3/2004 Ginsberg et al. ..... 206/535
6,752,272 B2 6/2004 Jones et al.
6,776,288 B2 * 8/2004 Kopecky ..... 206/538
6,802,422 B2 10/2004 Kalvelage et al.
6,848,580 B2 2/2005 Paliotta et al.
6,951,282 B2 10/2005 Jones
6,964,338 B2 11/2005 Kancsar et al.
6,978,894 B2 12/2005 Mundt
6,997,320 B1 2/2006 Kancsar et al.
6,997,344 B2 2/2006 Brown et al.
7,000,768 B2 2/2006 Morita et al.
7,025,207 B2 4/2006 Breu et al.
7,055,294 B1 6/2006 Lewis
7,063,211 B2 6/2006 Williams-Hartman
7,090,079 B2 8/2006 Ehrlund et al.
7,126,879 B2 10/2006 Snyder
7,188,728 B2 3/2007 Williams-Hartman
7,188,729 B2 * 3/2007 DeJonge ..... 206/535
7,308,984 B2 12/2007 Bouthiette et al.
7,336,564 B2 2/2008 Feodoroff et al.
2002/0045184 A1 4/2002 Chen
2002/0104773 A1 8/2002 Kalvelage et al.
2002/0134694 A1 * 9/2002 Cherng ..... 206/308.1
2002/0197098 A1 * 12/2002 Palmer ..... 402/79
2003/0031595 A1 2/2003 Kirchhevel et al.
2003/0032190 A1 2/2003 Brown et al.
2003/0034271 A1 2/2003 Burridge
2004/0026293 A1 * 2/2004 Hughes ..... 206/538
2004/0069675 A1 4/2004 Stevens
2004/0108240 A1 6/2004 Ragot
2004/0188315 A1 9/2004 Morita et al.
2005/0051454 A1 * 3/2005 Coe et al. ..... 206/536
2005/0082194 A1 4/2005 Fry et al.
2005/0102838 A1 5/2005 Leason
2005/0109658 A1 5/2005 Bindford
2005/0112194 A1 5/2005 Gervais et al.
2005/0173291 A1 8/2005 Specker et al.
2005/0178692 A1 8/2005 Chang
2005/0210682 A1 9/2005 Bartholin
2005/0238415 A1 * 10/2005 Busam et al. ..... 402/73
2005/0256830 A1 11/2005 Siegel et al.
2005/0269238 A1 12/2005 Reape et al.
2005/0274643 A1 12/2005 Arnold
2005/0274644 A1 12/2005 Williams-Hartman
2006/0021900 A1 2/2006 Feodoroff
2006/0042987 A1 3/2006 Buss
2006/0060597 A1 3/2006 Stevens
2006/0144749 A1 7/2006 Arnold et al.
2006/0249420 A1 11/2006 Hession
2006/0289328 A1 12/2006 Hession
2007/0023317 A1 2/2007 Brozell et al.
2007/0045149 A1 3/2007 Hession
2007/0048413 A1 3/2007 Glydon
2007/0056876 A1 3/2007 Jones
2007/0084746 A1 4/2007 Udo et al.
2007/0084747 A1 4/2007 Gherdan et al.
2007/0125679 A1 6/2007 Smith
2007/0205131 A1 9/2007 Bouthiette
2007/0205132 A1 9/2007 Bouthiette
2007/0205133 A1 9/2007 Valentine et al.
2007/0284280 A1 12/2007 Young
2008/0023366 A1 1/2008 Bouthiette
2008/0110791 A1 5/2008 Specker
2008/0265011 A1 10/2008 Specker
2009/0078051 A1 3/2009 Twerdochlib et al.
2009/0242451 A1 10/2009 Kessler

FOREIGN PATENT DOCUMENTS

DE 4420503 A1 2/1996
EP 1 270 441 A1 1/2003
EP 1 505 017 A1 2/2005
EP 1 505 018 A1 2/2005
EP 1 884 360 A2 2/2008
EP 1 930 251 A1 6/2008

| | | | |
|---|---|---|---|
| EP | 1 964 788 | A1 | 9/2008 |
| EP | 1 985 544 | B1 | 10/2008 |
| EP | 2 090 525 | A1 | 8/2009 |
| EP | 2 112 078 | A1 | 10/2009 |
| FR | 2750403 | A1 | 1/1998 |
| WO | WO-98/56704 | A2 | 12/1998 |
| WO | WO-03/053794 | A1 | 7/2003 |
| WO | WO 03/076303 | | 9/2003 |
| WO | WO-03/089333 | A1 | 10/2003 |
| WO | WO-2004/103857 | A1 | 12/2004 |
| WO | WO-2005/023672 | A1 | 3/2005 |
| WO | WO-2005/110864 | A1 | 11/2005 |
| WO | WO 2005/110889 | | 11/2005 |
| WO | WO-2005/110890 | A1 | 11/2005 |
| WO | WO-2007/046126 | A1 | 4/2007 |
| WO | WO-2009/078051 | A1 | 6/2009 |

OTHER PUBLICATIONS

Medicine-On-Time, "Home Page," Retrieved from the Internet on Oct. 8, 2008. URL:http://www.medicine-on-time.com.

MTS Medication Technologies, "Sureseal™," Retrieved from the Internet on Oct. 8, 2008. URL:http://www.mts-mt.com/index.php?module=NukeWrapper&url=/products/machine.html?idx=13.

* cited by examiner

MULTI-DOSE BLISTER CARD PILLBOOK

CROSS-REFERENCE TO RELATED APPLICATIONS

The priority benefit of each of the following U.S. Provisional Patent Applications is claimed, and the entire contents of each is hereby incorporated herein by reference: U.S. Provisional Patent Application No. 61/029,751, filed Feb. 19, 2008; U.S. Provisional Patent Application No. 60/947,169, filed Jun. 29, 2007; and U.S. Provisional Patent Application No. 60/940,790, filed May 30, 2007.

FIELD OF THE INVENTION

The present invention relates to blister cards for storing ingestible products such as medication, for example, and more particularly, to blister packs for storing multiple doses of medication for simultaneous ingestion.

BACKGROUND

Various products such as over-the-counter pharmaceuticals, or other medications, have conventionally been offered in single-dose blister cards for providing a consumer individual doses of the product. The blister cards generally comprise a thin sheet of transparent material defining a plurality of blisters. A removable foil backing is typically adhered to the transparent material for sealing each blister individually. Each blister contains a single dose such as one or two tablets of the subject medication, e.g., cold medicine. Some manufacturers of the blister cards include perforated seams between the individual blisters, thereby enabling a consumer to remove one or more blisters from the blister card for transporting or discarding, for example. Immediately prior to ingestion, the consumer needs only to apply a force to the blister and push the medicine through the foil backing.

Such conventional single-dose blister cards are also utilized by pharmacists for prescription medications. Additionally, in recent years, pharmacists have begun utilizing multi-dose blister cards. Multi-dose blister cards are constructed generally identical to single-dose blister cards, although slightly larger in some cases. For example, multi-dose blister cards include individual blisters sized and configured to accommodate multiple tablets, and more particularly, multiple doses of different medications. Such multi-dose blister cards can help reduce confusion among patients having to ingest multiple prescriptions, for example, on any given day.

One typical multi-dose blister card may include, for example, an individual blister for each day of the week, where each blister contains the prescribed medication for that day. Accordingly, the blisters for Monday, Wednesday, and Friday may contain, for example, two drug tablets, while the blisters for Tuesday and Thursday may contain three drug tablets. Accordingly, the patient must only identify the day of the week (and possibly the time of day) to ensure that all prescribed medications are properly ingested.

As mentioned, conventional multi-dose blister cards are larger than conventional single-dose blister cards because the blisters must be sized to accommodate multiple tablets, pills, or other drug delivery devices. The larger blister cards can therefore become bulky, cumbersome, and difficult to store on one's person such as in a purse, briefcase, or a coat pocket, for example.

SUMMARY

One aspect of the present disclosure provides a product package that includes a spine, a plurality of blister cards, and a coupler mechanism. Each blister card comprises a plurality of individual cells. Each individual cell comprises a blister for containing at least one product. The coupler mechanism is attached to the spine and re-attachably couples the plurality of blister cards within the product package.

In one embodiment, the coupler mechanism comprises an adhesive disposed between the spine and each of the plurality of blister cards.

In some embodiments, the coupler mechanism comprises an elongated member attached to the spine and each of the plurality of blister cards comprises a recess receiving the elongated member.

In such an embodiment, upper and lower ribs are disposed on the elongated member, and the blister cards each define a pair of arm portions. The arm portions extend into the recesses and hook onto the upper and lower ribs to re-attachably couple the plurality of blister cards to the coupler mechanism.

In some embodiments, the upper and lower ribs on the elongate member are constructed of a resilient material and the arm portions are constructed of a non-resilient material. In one embodiment, the resilient material comprises a resilient foam material.

In some embodiments, the upper and lower ribs on the elongate member are constructed of a non-resilient material and the arm portions are constructed of a resilient material.

In some embodiments, a pair of opposing end stops are disposed on the elongate member for preventing the plurality of blister cards from sliding off of the coupler mechanism.

In some embodiments, the pair of opposing end stops are removably disposed on the elongated member.

In at least one embodiment, the plurality of blister cards comprises a first blister card and a second blister card. The first blister card comprises a first plurality of blisters that are nested with a second plurality of blisters of the second blister card when the first and second blister cards are coupled into the product package via the coupler mechanism.

Some embodiments further comprise front and back covers hingedly coupled to the spine of the product package.

In some embodiments, each of the individual cells of the plurality of blister cards are separated by perforated seams.

In some embodiments, each of the plurality of blister cards comprises a plurality of openings. Each opening is disposed between at least two individual cells for facilitating removal of each individual cell from the respective blister card.

Further embodiments can comprise identification information disposed on each of the individual cells of each blister card. The identification information indicates to a user when to ingest the product stored within the blister associated with the respective individual cell.

Additionally, further embodiments can comprise identification indicia disposed on the spine. The identification indicia indicates to a user when to ingest the product stored within the blisters of the plurality of blister cards coupled within the product package.

Another aspect of the present disclosure provides a package system that comprises a first product package, a second product package, and a child-proof sleeve. The first product package comprises a first spine and a first plurality of blister cards re-attachably coupled to the first spine. The second product package comprises a second spine and a second plurality of blister cards re-attachably coupled to the second spine. The child-proof sleeve accommodates the first and second product packages such that the first and second product packages can be independently removed from and inserted into the child-proof sleeve.

In some embodiments, each blister card of the first and second pluralities of blister cards comprises a plurality of individual cells, wherein each individual cell comprises a blister for containing at least one product.

In some embodiments, a first coupler mechanism can be disposed between the first spine and each of the first plurality of blister cards, and a second coupler mechanism disposed between the second spine and each of the second plurality of blister cards.

In some embodiments, the first and second coupler mechanisms each comprises an elongated member attached to the respective spines and each of the blister cards comprises a recess receiving the respective elongated member.

In further embodiments, upper and lower ribs can be disposed on the elongated member; and a pair of arm portions can be defined by each of the blister cards of the first and second pluralities of blister cards. The arm portions extend into the respective recesses and hook onto the upper and lower ribs to re-attachably couple the blister cards to the respective coupler mechanisms.

In some embodiments, the upper and lower ribs on the elongate members are constructed of a resilient material and the arm portions are constructed of a non-resilient material.

In one embodiment, the resilient material comprises a resilient foam material.

In some embodiments, the upper and lower ribs on the elongate members are constructed of a non-resilient material and the arm portions are constructed of a resilient material.

In further embodiments, the first and second coupler mechanisms can each further comprise a pair of opposing end stops disposed on the elongate members for preventing the plurality of blister cards from sliding off of the coupling mechanisms.

In some embodiments, the pair of opposing end stops are removably disposed on the elongate members.

In at least one embodiment, the first and second pluralities of blister cards each comprises a first blister card and a second blister card. The first blister card comprises a first plurality of blisters that are nested with a second plurality of blisters of the second blister card.

In some embodiments, the first and second product packages each further comprises front and back covers hingedly coupled to the respective first and second spines.

DETAILED DESCRIPTION

Although the following text sets forth a detailed description of numerous different embodiments, it should be understood that the legal scope of the invention is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
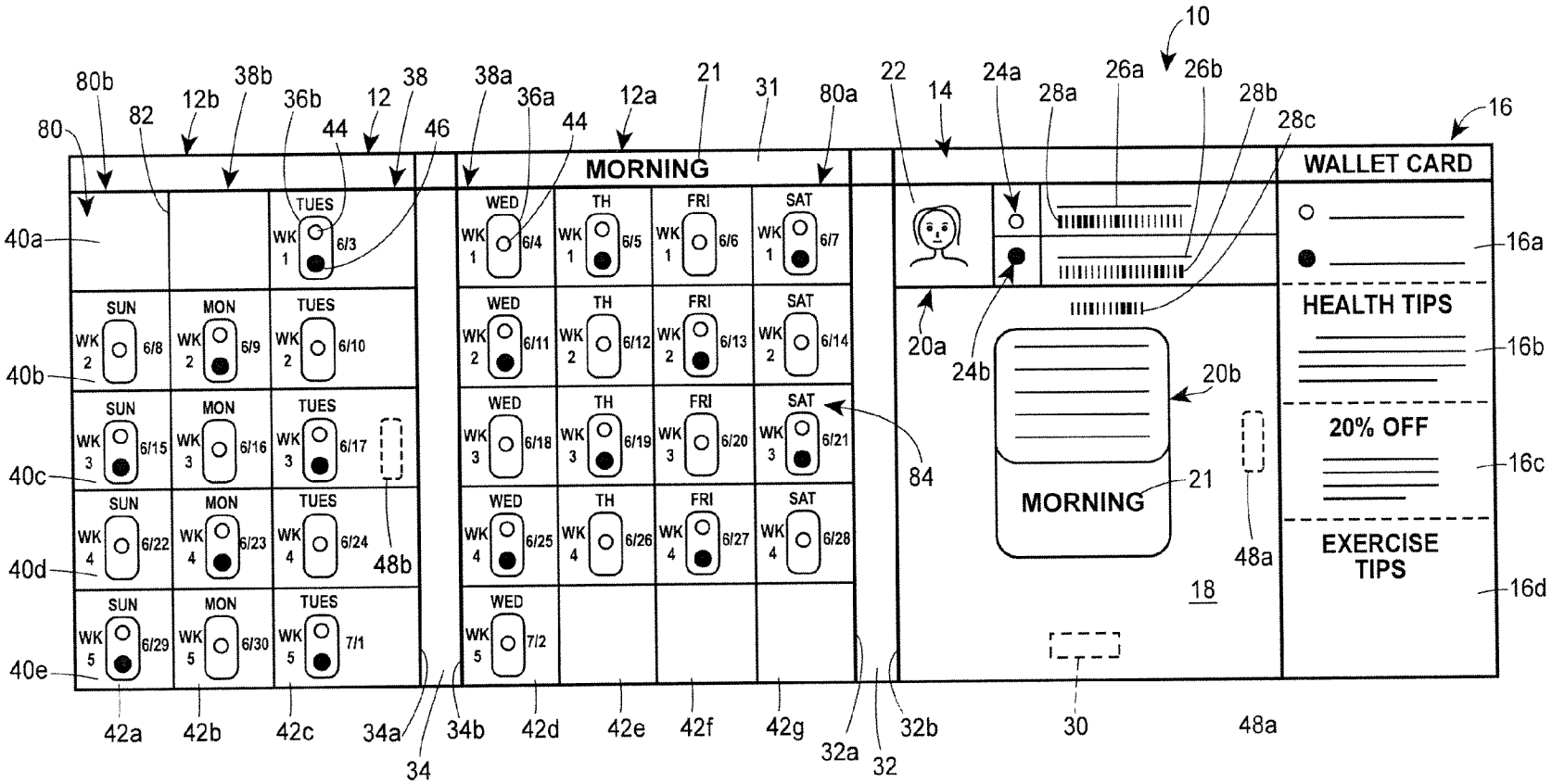
FIG. 1 is a plan view of one embodiment of a product package constructed in accordance with the principles of the present invention including a multi-dose blister card.

FIG. 1 depicts one embodiment of a product package 10 constructed in accordance with the present invention. The product package 10 generally includes a multi-dose blister card 12, a cover 14, and an optional information center 16. In one practical application, the multi-dose blister card 12 is adapted to contain products 44, 46 such as prescription medications, for example, for storage and ingestion by a patient. Throughout this description, reference numerals 44 and 46 may be referred to as products, or medications, or drugs. As will be described, the cover 14 and the blister card 12 are arranged and configured to allow the package 10 to be closed in a manner similar to a tri-fold pamphlet, or wallet, for example. The cover 14 may also contain identification information related to the prescription, the products 44, 46 stored in the multi-dose blister card 12, and/or the patient.

In the disclosed embodiment, the cover 14 includes an inside surface 18 carrying a first patient/prescription identification label 20*a* and a second patient/prescription identification label 20*b*. The first identification label 20*a* may include a black-and-white or color photograph 22 of the patient, and black-and-white or color photographs 24*a*, 24*b* of the products 44, 46 provided in the package 10. Moreover, adjacent to the photographs 24*a*, 24*b* of the products 44, 46, the first identification label 20*a* includes a brief description 26*a*, 26*b* and a product information storage device 28*a*, 28*b*, for each of the products 44, 46. The information storage devices 28*a*, 28*b* store information such as the name, strength or dosage, etc. for the respective products 44, 46 or medications. Further still, the first identification label 20*a* includes a composite information storage device 28*c*. The composite information storage device 28*c* stores information representing a combination of the information stored in the information storage devices 28*a*, 28*b* for the individual products 44, 46. In one embodiment, each product information storage device 28*a*-28*c* may include, for example, a bar code, a radio frequency identification (RFID) tag, or other memory device. The brief descriptions 26*a*, 26*b* may include a brief description of the respective products 44, 46 such as medications, provided in the package 10, as well as instructions for taking the medications such as "with breakfast," for example.

The second identification label 20*b* may include all the same information as the first identification label 20*a* (except for the photographs), and/or any different information. For example, the second identification label 20*b* may include the patient's name, address, age, physician's name, any specific health conditions, medication names, dosages, instructions for taking the medications, etc.

Additionally, in the disclosed embodiment, the second identification label 20*b* includes a time stamp 21, which is depicted in FIG. 1 as reading "MORNING." The time stamp 21 indicates at what time of day the products 44, 46 stored in the package 10 are to be ingested by the patient. With the present embodiment, a patient whom is prescribed one or more medications that are to be ingested at different times of the day, e.g., morning and night, may have multiple packages 10, where each package corresponds to the specific time for ingestion. The time stamp 21 may also be provided on a header 31 of the multi-dose blister card 12, as depicted in FIG. 1, on the other side of the cover 14, and/or in generally any other location on the package 10.

While the first identification label 20*a* has been described as including the photograph 22 of the patient, the photographs 24*a*, 24*b* of the products 44, 46, the product information storage devices 28*a*, 28*b*, and the composite information storage device 28*c*, alternative embodiments of the product package 10 may provide this information on the second identification label 20*b*. Accordingly, the information described above as being provided on the second identification label 20*b*, would be provided on the first identification label 20*a*.

Although not depicted, it should be appreciated that alternative embodiments of the package 10 can additionally, or alternatively, include any of the patient identification labels 20*a*, 20*b* and the product information storage devices 28*a*-28*c* on the outside surface of the cover 14. So configured, such information may be readily attainable without having to open the cover 14. Furthermore, the outside surface of the cover 14 may additionally include other information such as a corporate logo identifying the entity that filled the prescription, a holographic image, another bar code or other readable information storage device storing patient information, prescription information, physician information, or any other information. In one embodiment, the bar code on the outside surface of the cover 14 may be provided with invisible ink, which may be readable under ultra-violet light, for example. Further still, in alterative embodiments, the first and second identification labels 20*a*, 20*b* may not include labels at all, but rather may be printed directly onto the cover 14, for example.

As mentioned above, the disclosed embodiment of the package 10 may also include the information center 16. The information center 16 includes a plurality of tear-off cards 16*a*-16*d*, for example. The top card 16*a* may include a wallet card. The wallet card 16*a* may include patient and/or prescription information similar to the information presented in the first and/or second identification labels 20*a*, 20*b*. So configured, the patient may detach the top card 16*a* from the package 10 and carry it with him/her as a quick-reference guide for taking the products 44, 46, or other medications. The remaining tear-off cards 16*b*-16*d* may include, for example, "Health Tips," coupons, "Exercise Tips," or any other information related to or unrelated to the specific prescription and/or patient. Moreover, the tear-off cards 16 may include targeted marketing, coupon, or any other information that may be useful to the patient and/or a caregiver, for example.

Additionally, the depicted embodiment of the package 10 may include a timer 30 such as an electronic timer for signaling to a patient when to take his/her medication. The timer 30 is depicted in phantom in FIG. 1 such that it may be understood that the timer 30 may be retained between multiple plies of the material forming the cover 14 such that a visual indicator such as a blinking light may be disposed on an outside surface of the cover 14. In another embodiment, the timer 30 may include an audible indicator such as a speaker for emitting a beep, for example. In another embodiment, the timer 30 may include a transmitter that sends a signal to a pager, a cell phone, an e-mail account, a land-line telephone, or any other device for reminding a patient to take his/her medicine at a particular time. In one embodiment, the timer 30 may be programmed to enable the patient to download his/her own sounds, chimes, or music, for example.

In still another embodiment, the cover 14 may include a pocket (not shown) for storing letters, leaflets, disease state brochures, or any other type of information for the patient. Such information may be stored on a readable medium such as an instructional DVD, for example.

Still referring to FIG. 1, the multi-dose blister card 12 of the package 10 includes a first blister card portion 12*a* and a second blister card portion 12*b*. The first blister card portion 12*a* is attached to the cover 14 by a first spine 32. The first spine 32 includes a first seam 32*a* and a second seam 32*b*. The first seam 32*a* of the first spine 23 is connected to the first blister card portion 12*a*. The second seam 32*b* of the first spine 32 is connected to the cover 14. The second blister card portion 12*b* is attached to the first blister card portion 12*a* by a second spine 34. The second spine 34 includes a first seam 34*a* and a second seam 34*b*. The first seam 34*a* of the second spine 34 is connected to the second blister card portion 12*b*. The second seam 34*b* of the second spine 34 is connected to the first blister card portion 12*a*.

The first blister card portion 12*a* of the disclosed embodiment also includes a first group of individual blister cards, or cells 80*a*. The second blister card portion 12*b* includes a second group of individual blister cards, or cells 80*b*. In the disclosed embodiment, the cells 80*a*, 80*b* are connected to each other by perforated seams 82. For the sake of clarity, only a single perforated seam 82 is expressly identified by reference numeral in FIG. 1, but it should be appreciated that each of the seams between each of the cells 80*a*, 80*b* may be perforated. Additionally, the first and second seams 34*a*, 34*b* of the second spine 34 may also be perforated, as well as the first seam 32*a* of the first spine 32. The perforated seams 82, 34*a*, 34*b* and 32*a* enable a user to detach one or more of the cells 80*a*, 80*b* from the package 10 to carry cells 80*a*, 80*b* away for ingestion of the medications 44, 46 stored therein at a later time, or to discard empty cells 80*a*, 80*b*, for example.

The first and second groups of cells 80*a*, 80*b* are arranged in first and second matrices 38*a*, 38*b*, respectively. The first matrix 38*a* includes a four-by-five matrix. The second matrix 38*b* includes a three-by-five matrix. Accordingly, in combination, the cells 80*a*, 80*b* of the embodiment of the multi-does blister card 12 depicted in FIG. 1 generally define a five-by-seven composite matrix 38 including a total of thirty-five cells 80. The composite matrix 38 is generally arranged in a traditional matrix, but for the inclusion of the second spine 34 disposed between the first and second matrices 38*a*, 38*b*. Accordingly, the composite matrix 38 includes first through fifth rows 40*a*-40*e* and first through seventh columns 42*a*-42*g*. Each row 40*a*-40*e* is assigned to a week of the prescription, i.e., "Wk. 1," "Wk. 2," "Wk. 3," "Wk. 4," and "Wk. 5." Each column 42*a*-42*g* is assigned to a day of the week, i.e., "Sunday," "Monday," "Tuesday," "Wednesday," "Thursday," "Friday," and "Saturday." As illustrated in FIG. 1, the second blister card portion 12*b* includes first through third columns 42*a*-42*c* of cells 80 and the first blister card portion 12*a* includes fourth through seventh columns 42*d*-42*g* of cells 80.

For the sake of description, the cells 80*a* of the first blister card portion 12*a* are each adapted to accommodate a blister 36*a*. Similarly, the cells 80*b* of the second blister card portion 12*b* are each adapted to accommodate a blister 36*b*. However, the disclosed multi-dose blister card 12 only includes a thirty-day prescription that begins on "Tuesday" of "Wk. 1" and ends on "Wednesday" of "Wk. 5." Accordingly, not every cell 80*a*, 80*b* contains product such as medications, and therefore, not every cell 80*a*, 80*b* contains a blister 36*a*, 36*b*. For example, for the disclosed thirty-day prescription, the second blister card portion 12*b* of the multi-dose blister card 12 does not include blisters 36*b* in the cells 80*b* located in the first and second columns 42*a*, 42*b* of the first row 40*a*, which correspond to "Sunday" and "Monday" of "Wk. 1." Additionally, the first blister card portion 12*a* of the multi-dose blister card 12 does not include blisters 36*a* in the cells 80*a* located in the fifth through seventh columns 42*e*-42*f* of the fifth row 40*e*, which correspond to "Thursday" through "Saturday" of "Wk. 5." So configured, a patient prescribed the multi-dose blister card 12 depicted in FIG. 1 will clearly understand that the prescription begins on "Tuesday" of "Wk. 1" and ends on "Wednesday" of "Wk. 5." In alternative embodiments, every cell 80*a*, 80*b* of the multi-dose blister card 12 may include a blister 36*a*, 36*b*, but only those cells 80*a*, 80*b* corresponding to the particular days of the prescription would actually contain medication. Additionally, the product package 10 may have start and finish arrows to indicate the first and last blister for each prescription. The package may also include arrows between the blisters 236*a*, 236*b* indicating the next blister 236*a*, 236*b* to be used. Also, the package will have a notice that will indicate, with an arrow, for example, the last day that a patient may modify the package.

In addition to the blisters 36*a*, 36*b*, each cell 80*a*, 80*b* includes indicia 84 printed thereon. The indicia 84 indicates to the patient when to take the product 44, 46 such as medications, stored therein. For example, as depicted in FIG. 1, the indicia 84 on each cell 80*a*, 80*b* includes the day, the date, and the time of day corresponding to when the medications 44, 46 are to be ingested. Therefore the patient will easily be able to identify what products to take at what times. For example, the blister 36*b* located in the third column 42*c* of the first row 40*a* of the composite matrix 38, which corresponds to "Tuesday" Morning of "Wk. 1," includes two tablets 44 and 46. Thus, the patient that has been prescribed the multi-dose blister card 12 knows to ingest both tablets 44 and 46 during the Morning on "Tuesday" of "Wk. 1." In contrast, the blister 36*a* located in the fourth column 42*d* of the first row 40*a*, which corresponds to "Wednesday" Morning, of "Wk. 1," includes a single tablet 44. Accordingly, the patient knows to ingest the single tablet 44 during the Morning on "Wednesday" of "Wk. 1," etc.

In alternative embodiments, the indicia 84 may include additional and/or alternative information related to the products 44, 46, for example, such as identification information, strength information, and/or any other information. Further still, in one embodiment, the indicia 84 may also be provided on the opposite sides of the cells 80*a*, 80*b*, i.e., the back-sides of the cells 80*a*, 80*b*, opposite the blisters 36*a*, 36*b*. So configured, the patient may be able to readily identify when to take the medications 44, 46 stored in each blister 36*a*, 36*b*. In another embodiment, the product package 10 may include indicia on one or both of the first and second spines 32, 34, for example, indicating how to open the blisters 36*a*, 36. For example, one form of the indicia may include an icon that depicts a finger pushing through the blister.

The blisters 36*a*, 36*b* include plastic containers formed integral with the cells 80*a*, 80*b*. That is, the cells 80*a*, 80*b* and the blisters 36*a*, 36*b* are formed from a single sheet of plastic material. In an alternative embodiment, however, the blisters 36*a*, 36*b* may be attached to the cells 80*a*, 80*b*, which may be constructed of plastic, paper, cardboard, or generally any other material. The blisters 36*a*, 36*b* may include transparent plastic containers, thereby enabling the patient to see the medications 44, 46 therethrough. In the disclosed embodiment, the blisters 36 are generally rectangular with rounded corners and sized and configured to accommodate one or more standard-sized drug delivery tablets, pills, etc. For example, the blisters 36 may include width dimensions between approximately 0.75" and approximately 0.875", length dimensions between approximately 1.25" and approximately 1.375", and height dimensions between approximately 0.625" and approximately 0.875".

The multi-dose blister card 12 depicted in FIG. 1 is only one example of how various drugs may be stored for a particular patient. It should be appreciated that the blisters 36 of the multi-dose blister card 12 may contain generally any number of tablets for ingestion by the particular patient, in accordance with generally any prescription(s). A limitation on the number of tablets or variations of prescriptions stored by the multi-dose blister card 12 may be the size of the individual blisters 36 and/or the products 44, 46 stored therein. Nevertheless, it is foreseeable that the principles of the present invention may be applied to multi-dose blister cards having blisters of generally any size and configuration.

Figure 2:
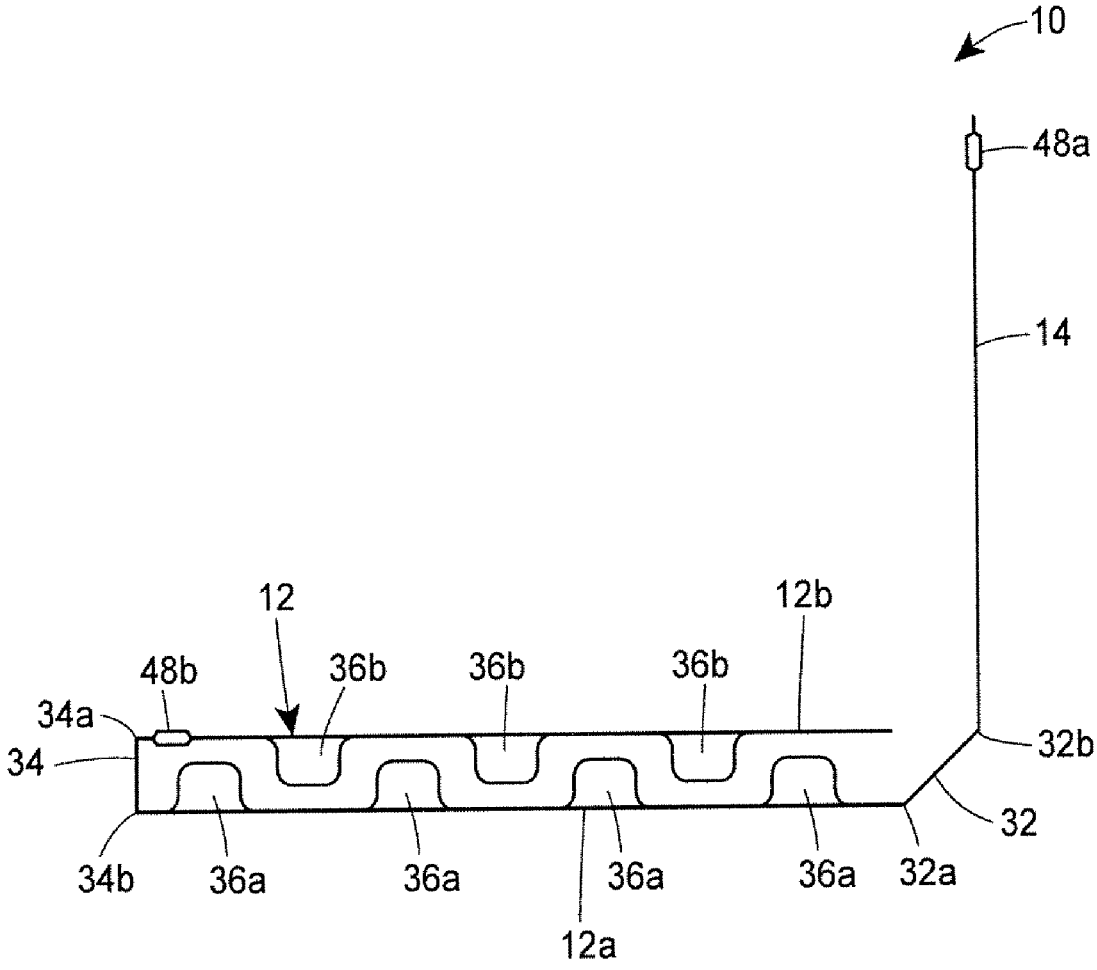
FIG. 2 is an end view of the product package of FIG. 1 in a partially closed configuration.

As mentioned above, the cover 14 and the multi-dose blister card 12 of the present embodiment of the product package 10 are arranged and configured as a tri-fold product package 10. Specifically, the first blister card portion 12*a* is attached to the cover 14 at the first spine 32, and the second blister card portion 12*b* is attached to the first blister card portion 12*a* at the second spine 34. The second blister card portion 12*b* folds along the first seam 34*a* of the second spine 34 and nests with the first blister card portion 12*a*, as depicted in FIG. 2. Additionally, as illustrated in FIG. 2, the second spine 34 folds along the second seam 34*b* of the second spine 34. So configured, when the second blister card portion 12*b* is folded onto the first blister card portion 12*a*, as depicted in FIG. 2 the blisters 36*b* carried by the second blister card portion 12*b* become nested with, or interleaved between, the blisters 36*a* carried by the first blister card portion 12*a*. This reduces the overall thickness of the folded product package 10.

To completely close the product package 10, the cover 14 is folded on top of the second blister card portion 12*b*. For example, the cover 14 folds along the first seam 32*a* disposed between the cover 14 and the first spine 32, while the first spine 32 folds along the second seam 32*b* disposed between the first spine 32 and the first blister card portion 12*a*. Accordingly, when the second blister card portion 12*b* is folded into the first blister card portion 12*a* and the cover 14 is folded over the second blister card portion 12*b*, the first and second spines 32, 34 are disposed substantially perpendicular to the first and second blister card portions 12*a*, 12*b*.

Referring back to FIG. 1, each cell 80 of the multi-dose blister card 12 is substantially identical in size, except for the cells 80 occupying the third column 42*c* of the composite matrix 38. In the disclosed embodiment, the cells 80 occupying the third column 42*c* of the multi-dose blister card 12 are slightly wider than the remaining cells 80. The wider cells 80 are sized to enable the nesting, or interleaving, of the blisters 36, as depicted in FIG. 2. In alternative embodiments, however, the multi-dose blister cards 12 may be sized and arranged completely differently such that all the cells 80, including the third column 42*c* of cells 80, are identical in size.

Moreover, as depicted in FIG. 2, the spines 32, 34 of the multi-dose blister card 12 include width dimensions that are slightly larger than a height dimension of the blisters 36. Thus, when the multi-dose blister card 12 is folded, as partially depicted in FIG. 2, the spines 32, 34 are disposed substantially perpendicular to the first and second blister card portions 12*a*, 12*b*. The wider dimensions of the spines 32, 34 enable for the blisters 36*a* on the first blister card portion 12*a* to accommodate the blisters 36*b* on the second blister card portion 12*b*, and vice versa, as illustrated.

In one embodiment, the cover 14 and the second blister card portion 12*b* additionally include closure elements 48*a* and 48*b*, respectively. The closure elements 48*a*, 48*b* secure the cover 14 into a closed position (not shown) in engagement with the second blister card portion 12*b*. In one embodiment, the closure elements 48*a*, 48*b* may comprise magnets. In another embodiment, the closure elements 48*a*, 48*b* may include hook and loop fasteners such as Velcro®, for example, or any other means for creating a secure closure. As depicted in FIG. 2, the closure elements 48*a*, 48*b* may be installed between, or directly upon, the one or more layers of plastic, cardboard, paper, or other material(s) that constitute the cover 14 and second blister card portion 12*b*. In other embodiments such as embodiments including hook and loop type fasteners, the closure elements 48*a*, 48*b* may be installed on external surfaces of the cover 14 and second blister card portion 12*b* such that the closure elements 48*a*, 48*b* directly engage each other. In still further embodiments, the closure elements 48*a*, 48*b* may include child safety locks, for example. In another embodiment, the product package 10 may be stored in a child-resistant sleeve.

Figure 3:
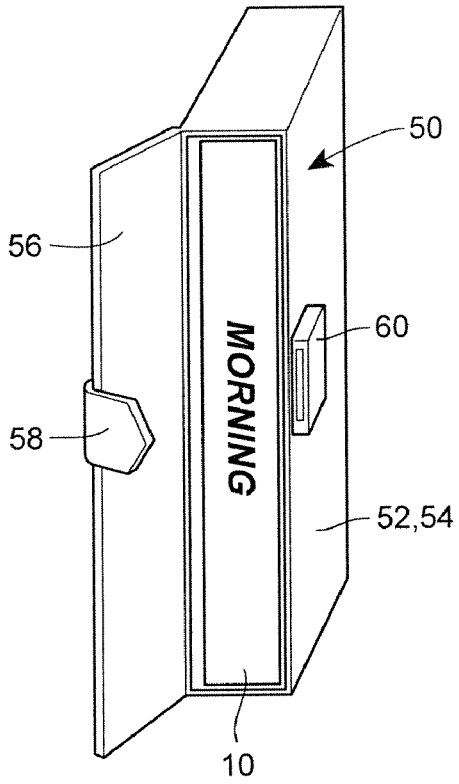
FIG. 3 is a perspective view of a child-resistant storage container for use with multi-dose blister cards in accordance with one embodiment of the present invention.

For example, FIG. 3 depicts one embodiment of a child-resistant sleeve 50 for a patient to store the product package 10. The sleeve 50 includes a container 52 comprising a storage box 54 and a hinged door 56. The disclosed embodiment of the container 52 includes a child-resistant container 52. The door 56 includes a child-resistant latch mechanism 58 for latching a latch 60 disposed on the box 54.

Figure 4:
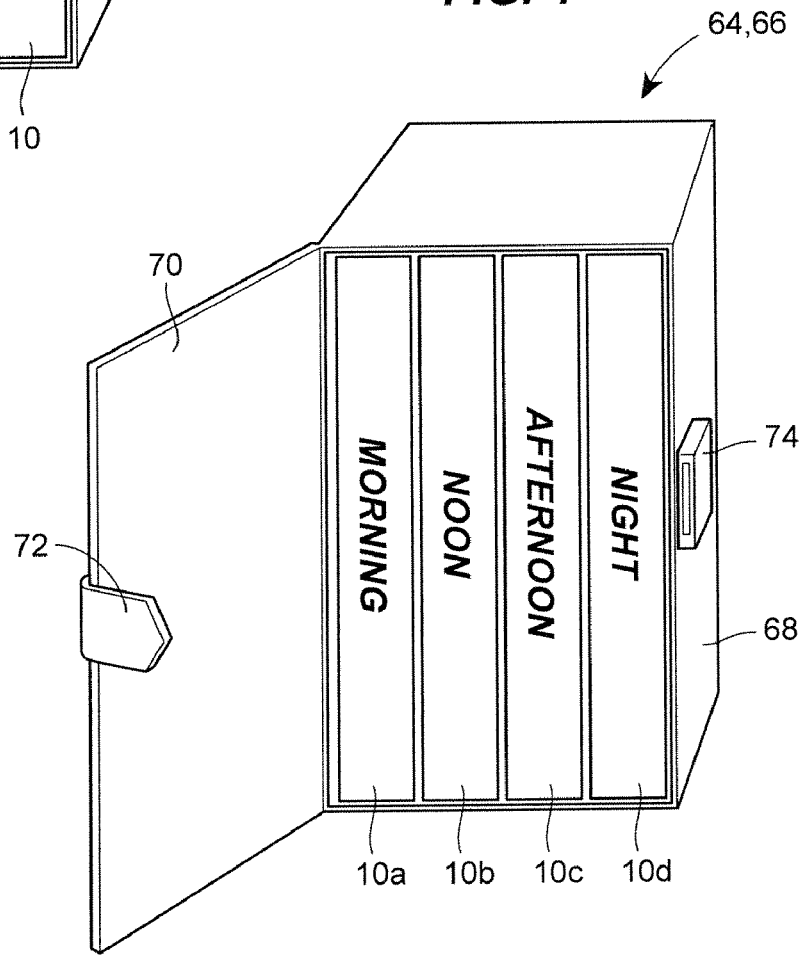
FIG. 4 is a perspective view of a child-resistant storage container for use with multi-dose blister cards in accordance with an alternative embodiment of the present invention.

As mentioned, any single product package 10 of the embodiment depicted in FIGS. 1 and 2 is designed to contain one or more prescriptions for a particular time of day, i.e., "Morning," for a given prescription period. Thus, a patient with a prescription that requires ingestion at different times of the day may require multiple product packages 10, where each package 10 is assigned to a distinct time of day, e.g., "Morning," "Noon," "Evening," "Night." FIG. 4 therefore depicts a system 64 for a patient to store multiple product packages 10*a*-10*d*, each package 10*a*-10*d* including a multi-dose blister card 12 constructed accordance with the configuration depicted in FIGS. 1 and 2. The system 64 includes a container 66 comprising a storage box 68 and a hinged door 70. The container 66 of the embodiment depicted in FIG. 4 is sized and configured to contain four packages 10*a*-10*d*. However, alternative embodiments of the container 66 may be sized and configured to contain any number of product packages 10 as required for any particular patient's prescription (s). Additionally, the disclosed embodiment of the container 66 includes a child-resistant container 66. The door 70 includes a child-resistant latch mechanism 72 for latching a latch 74 disposed on the box 68.

While the storage boxes 54, 68 depicted in FIGS. 3 and 4 are generally illustrated without any specific indicia printed thereon, alternative embodiments of the storage boxes 54, 68 may include any type of indicia, graphic, text, or other representation. For example, with reference to FIG. 3, the storage box 54 may include a time stamp indicating what time of day the product package 10 stored therein corresponds to, e.g. "Morning." Moreover, the storage boxes 54, 68 of either embodiment depicted in FIGS. 3 and 4 may be color-coded for the specific patient, thereby allowing multiple patients within the same household to readily identify which storage box 54, 68 contains their medication. Further still, the storage boxes 54, 68 or the individual cards may be customized or decorated to replicate, for example, a leather-bound journal, desk reference, dictionary, novel, or other any other decorative or non-decorative article. Still further, the boxes 54, 68 may be decorated according to a season, a holiday, or any other occasion or to the patient's liking.

Figure 5:
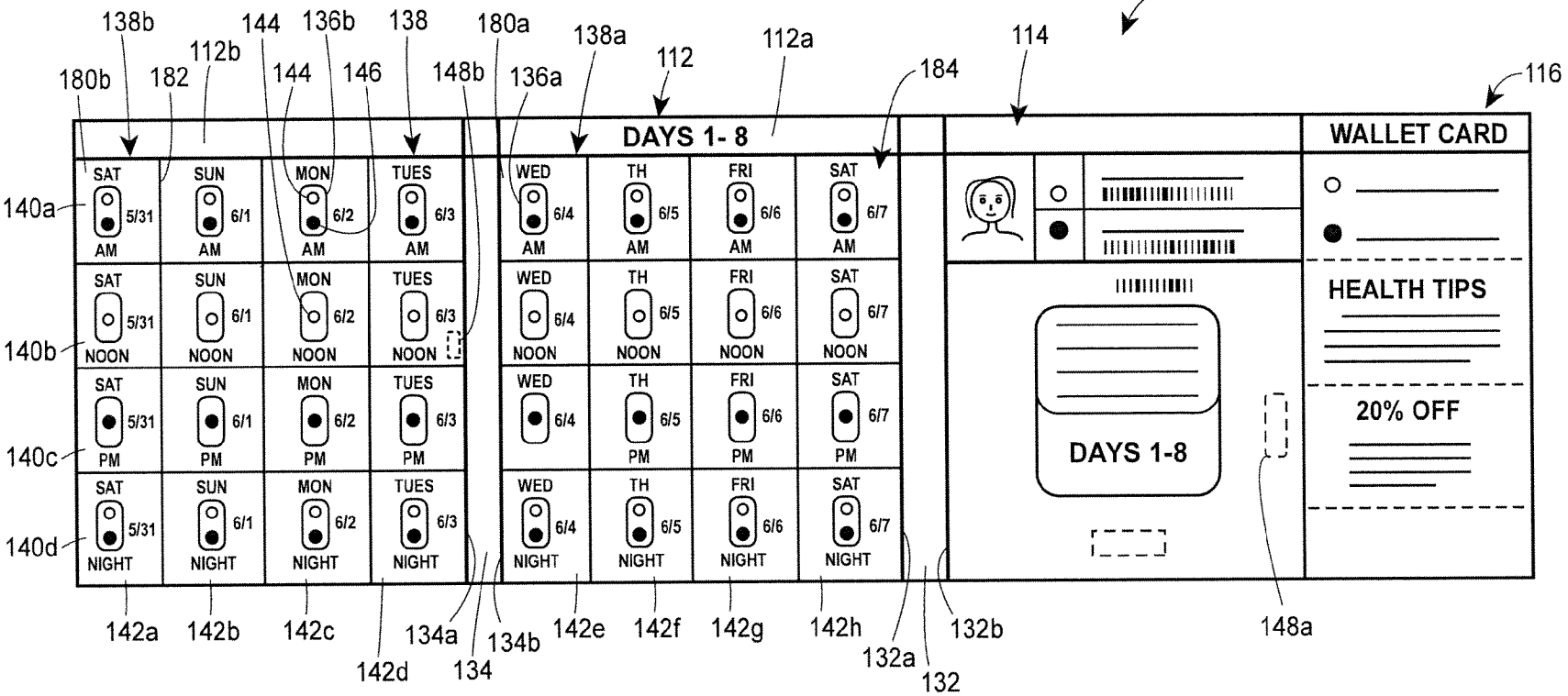
FIG. 5 is a plan view of an alternative embodiment of a product package constructed in accordance with the principles of the present invention including a multi-dose blister card.

While the product package 10 has thus far been described as being adapted to store products 44, 46, or medications, for ingestion at a particular time of day, i.e., "Morning," for a complete thirty-day prescription, the present invention is not limited to such a configuration and/or arrangement. For example, FIG. 5 depicts an alternative tri-fold product package 100 including an alternative multi-dose blister card 112 in accordance with the principles of the present invention. The product package 100 depicted in FIG. 5 is generally similar to the package 10 depicted in FIG. 1 in that it includes a multi-dose blister card 112, a cover 114, and an optional information center 116. The cover 114 and the information center 116 are substantially identical to the cover 14 and information center 16 described above with reference to the package 10 and, therefore, the specific details of each will not be repeated. The multi-dose blister card 112 depicted in FIG. 5, however, is adapted to store products 144, 146 such as medications, for ingestion at four distinct times of the day, for the first eight days of a thirty-day prescription, for example, as opposed to only one time of day, e.g., the "Morning," as described above with reference to FIG. 1.

Specifically, the multi-dose blister card 112 of the package 100 includes a first blister card portion 112*a* and a second blister card portion 112*b*. The first blister card portion 112*a* is attached to the cover by a first spine 132. The first spine 132 includes a first seam 132*a* and a second seam 132*b*. The first seam 132*a* of the first spine 123 is connected to the first blister card portion 112*a*. The second seam 132*b* of the first spine 132 is connected to the cover 114. The second blister card portion 112*b* is attached to the first blister card portion 112*a* by a second spine 134. The second spine 134 includes a first seam 134*a* and a second seam 134*b*. The first seam 134*a* of the second spine 134 is connected to the second blister card portion 112*b*. The second seam 134*b* of the second spine 134 is connected to the first blister card portion 112*a*.

The first blister card portion 112*a* of the disclosed embodiment also includes a first group of individual blister cards, or cells 180*a*. The second blister card portion 112*b* includes a second group of individual blister cards, or cells 180*b*. The cells 180*a*, 180*b* are connected to each other by perforated seams 182. For the sake of clarity, only a single perforated seam 182 is expressly identified by reference numeral in FIG. 5, but it should be appreciated that each of the seams between each of the cells 180*a*, 180*b* may be perforated. Additionally, the first and second seams 134*a*, 134*b* of the second spine 134 may also be perforated, as well as the first seam 132*a* of the first spine 132. The perforated seams 182, 134*a*, 134*b* and 132*a* enable a user to detach one or more of the cells 180*a*, 180*b* from the package 100 to carry the cells 180*a*, 180*b* away for ingestion at a later time, or to discard cells 180*a*, 180*b*, for example.

The first and second groups of cells 180*a*, 180*b* are arranged in first and second matrices 138*a*, 138*b*, respectively. The first matrix 138*a* includes a four-by-four matrix. The second matrix 138*b* also includes a four-by-four matrix. Accordingly, in combination, the cells 180*a*, 180*b* of the embodiment depicted in FIG. 5 generally define a four-by-eight composite matrix 138 including a total of thirty-two cells 180*a*, 80*b*. The composite matrix 138 is generally arranged in a traditional matrix, but for the inclusion of the second spine 134 disposed between the first and second matrices 138*a*, 138*b*. Accordingly, the composite matrix 138 includes first through fourth rows 140*a*-140*d* and first through eighth columns 142*a*-142*h*. Each row 140*a*-140*d* is assigned to a specific time of day, i.e., "Morning," "Noon," "Evening," "Night." Each column 142*a*-142*h* is assigned to one of the first eight days of the prescription, i.e., "Saturday," "Sunday," "Monday," "Tuesday," "Wednesday," "Thursday," "Friday," and "Saturday." Therefore, as illustrated in FIG. 5, the second blister card portion 112*b* includes the first through fourth columns 142*a*-142*d* of cells 180*b* and the first blister card portion 112*a* includes the fifth through eighth columns 142*e*-142*h* of cells 180*a*.

For the sake of description, the cells 180*a* of the first blister card portion 112*a* are each adapted to accommodate a blister 136*a*. Similarly, the cells 180*b* of the second blister card portion 112*b* are each adapted to accommodate a blister 136*b*. Each blister 136*a*, 136*b* includes a plastic container attached to or integrally formed with the cells 180*a*, 180*b*. The blisters 136*a*, 136*b* are identical to the blisters 36*a*, 36*b* described above with reference to the product package 10 depicted in FIG. 1.

So configured, each blister 136*a*, 136*b* carried by the cells 180*a*, 180*b* of the multi-dose blister card 112 of FIG. 5 contains a specified dose of one or more drugs for ingestion by a patient at a particular time, on a particular day, of a prescription. For example, the blister 136*a* located in the third column 142*c* of the first row 140*a* of the composite matrix 138, which corresponds to "Monday" "Morning," includes two tablets 144 and 146. Thus, the patient that has been prescribed the multi-dose blister card 112 knows to ingest both tablets 144 and 146 during the "AM" on "Monday." In contrast, the blister 136*a* located in the third column 142*c* of the second row 140*b*, which corresponds to "Monday" "Noon," includes a single tablet 144. Accordingly, the patient knows to ingest the single tablet 144 at "Noon" on "Monday."

In addition to the blisters 136*a*, 136*b*, each cell 180*a*, 180*b* includes indicia 184 printed thereon indicating to the patient when to take the product 144, 146, or medications, stored therein. For example, as depicted in FIG. 5, each cell 180*a*, 180*b* includes the day, the date, and the time of day corresponding to when the products 144, 146 stored in each particular cell 180*a*, 180*b* are to be ingested. In alternative embodiments, the indicia 184 may include additional and/or alternative information related to the products 144, 146, for example, such as identification information, strength information, and/or any other information. Further still, in one embodiment, the indicia 184 may also be provided on the opposites sides the cells 180*a*, 180*b*, i.e., the back-sides of the cells 180*a*, 180*b* opposite of the blisters 136*a*, 136*b*. So configured, the patient may be able to readily identify when to take the products 144, 146, or medications, stored in each blister 136*a*, 136*b*.

The multi-dose blister card 112 depicted in FIG. 5 is another example of how various medications may be stored for a particular patient. It should be appreciated that the blisters 136 of the multi-dose blister card 112 may contain generally any number of tablets for ingestion by the particular patient, in accordance with generally any prescription(s). A limitation on the number of tablets or variations of prescriptions stored by the multi-dose blister card 112 may be the size of the individual blisters 136 and/or the products 144, 146 stored therein. Nevertheless, it is foreseeable that the principles of the present invention may be applied to multi-dose blister cards having blisters of generally any size and configuration.

Figure 6:
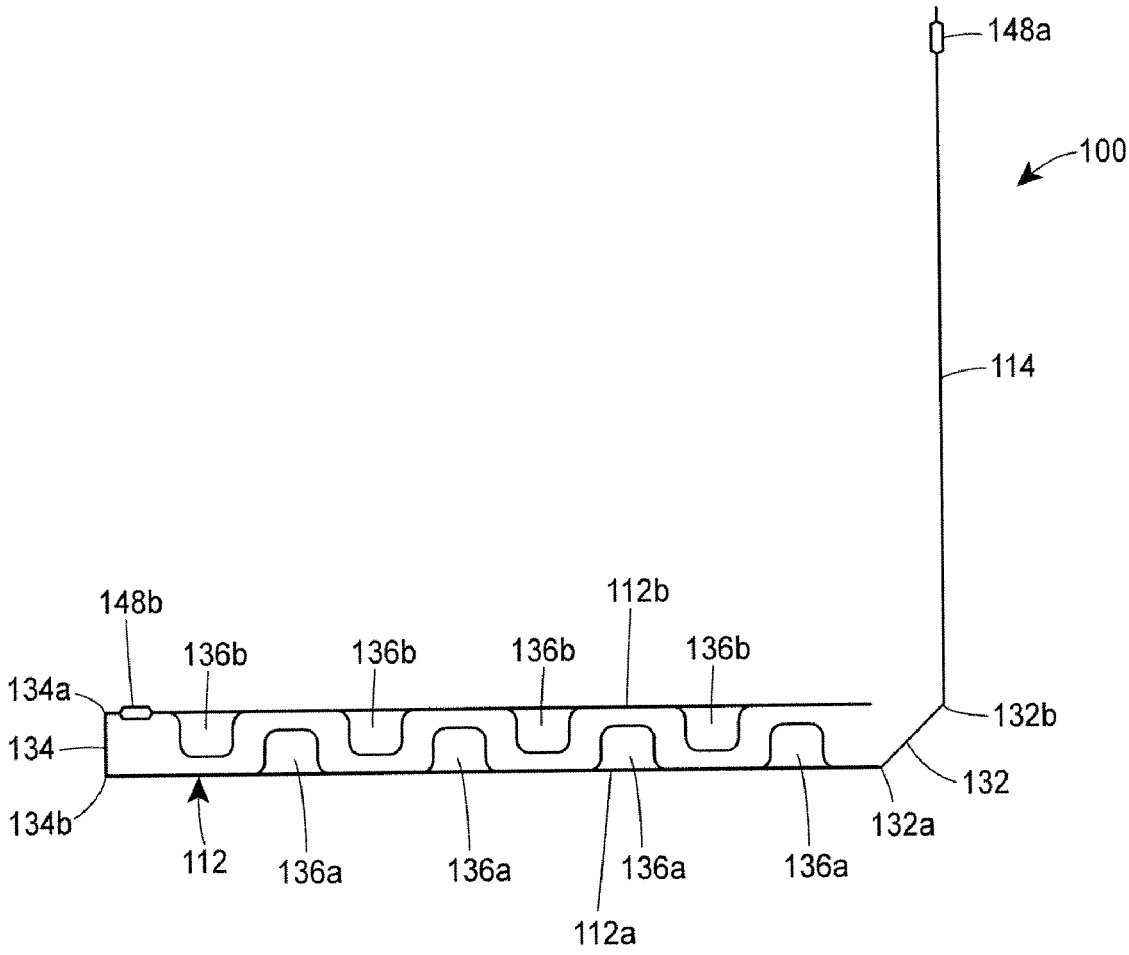
FIG. 6 is an end view of the product package of FIG. 5 in a partially closed configuration.

As mentioned above, the cover 114 and the multi-dose blister card 112 of the present embodiment of the product package 100 are arranged and configured as a tri-fold product package 100. Specifically, the first blister card portion 112*a* is attached to the cover 114 at the first spine 132, and the second blister card portion 112*b* is attached to the first blister card portion 112*a* at the second spine 134. The second blister card portion 112*b* folds along the first seam 134*a* of the second spine 134 and nests with the first blister card portion 112*a*, as depicted in FIG. 6. Additionally, as illustrated in FIG. 6, the second spine 134 folds along the second seam 134*b* of the second spine 134. So configured, when the second blister card portion 112*b* is folded onto the first blister card portion 112*a*, the blisters 136*b* carried by the second blister card portion 112*b* become nested with, or interleaved between, the blisters 136*a* carried by the first blister card portion 112*a*. This advantageously reduces the overall thickness of the folded product package 100.

To completely close the product package 100, the cover 114 is folded on top of the second blister card portion 112*b*. For example, the cover 114 folds along a first seam 132*a* disposed between the cover 114 and the first spine 132, while the first spine 132 folds along a second seam 132*b* disposed between the first spine 132 and the first blister card portion 112*a*. Accordingly, when the second blister card portion 112*b* is folded into the first blister card portion 112*a* and the cover 114 is folded over the second blister card portion 112*b*, the first and second spines 132, 134 are disposed substantially perpendicular to the first and second blister card portions 112*a*, 112*b*.

As illustrated, each cell 180*a*, 180*b* of the multi-dose blister card 112 depicted in FIGS. 5 and 6 is substantially identical in size, except for the cells 180 occupying the fourth column 142*d* of the composite matrix 138. In the disclosed embodiment, the cells 180*b* occupying the fourth column 142*d* of the multi-dose blister card 112 are slightly wider than the remaining cells 180*a*, 180*b*. The wider cells 180*b* are sized to enable the nesting, or interleaving, of the blisters 136*a*, 136*b*, as depicted in FIG. 6. In alternative embodiments, however, the multi-dose blister cards 112 may be sized and arranged completely differently such that all the cells 180*a*, 180*b*, including the fourth column 142*d* of cells 180*a*, 180*b*, are identical in size.

Moreover, as depicted in FIG. 6, the spines 132, 134 of the multi-dose blister card 112 include width dimensions that are slightly larger than a height dimension of the blisters 136*a*, 136*b*. Thus, when the multi-dose blister card 112 is folded, as partially depicted in FIG. 6, the spines 132, 134 are disposed substantially perpendicular to the first and second blister card portions 112*a*, 112*b*. The wider dimensions of the spines 132, 134 enable for the blisters 136*a* on the first blister card portion 112*a* to accommodate the blisters 136*b* on the second blister card portion 112*b*, and vice versa, as illustrated.

In one embodiment, the cover 114 and the second blister card portion 112*b* may also include closure elements 148*a* and 148*b*, respectively. The closure elements 148*a*, 148*b* secure the cover 114 into a closed position (not shown) in engagement with the second blister card portion 112*b*. The closure elements 148*a*, 148*b* may be identical to the closure elements 48*a*, 48*b* described above with reference to the product package 10 depicted in FIGS. 1 and 2.

As mentioned, the product package 100 depicted in FIGS. 5 and 6 is adapted to store products 144, 146 such as medications, for ingestion by a patient for the first eight days of the prescription. Accordingly, the patient prescribed the multi-dose blister card 112 incorporated into the package 100 would require additional product packages 100 for the remaining twenty-two days of the prescription. Specifically, in the disclosed embodiment, the patient would require three additional packages 100. A second package 100 would accommodate products 144, 146 for the ninth through sixteenth days of the prescription, a third package 100 would include products 144, 146 for the seventeenth through twenty-fourth days of the prescription, and a fourth package 100 would include products 144, 146 for the twenty-fifth through thirtieth days of the prescription. The second and third packages 100 would be substantially identical to the package 100 depicted in FIG. 5, but for the specific labeling provided on the cells 180*a*, 180*b* and the cover 114, for example, while the fourth package 100 would not include products 144, 146 stored in the seventh and eighth columns 142*g*, 142*h* because these cells 180*b* correspond to days thirty-one and thirty-two.

It should be appreciated that while the product package 100 disclosed with reference to FIGS. 5 and 6 includes a multi-dose blister card 112 for storing products 144, 146 for the first eight days of a thirty-day prescription, alternative embodiments of the product package 100 may be arranged to accommodate generally any number of days for generally any duration of prescription.

Figure 7:
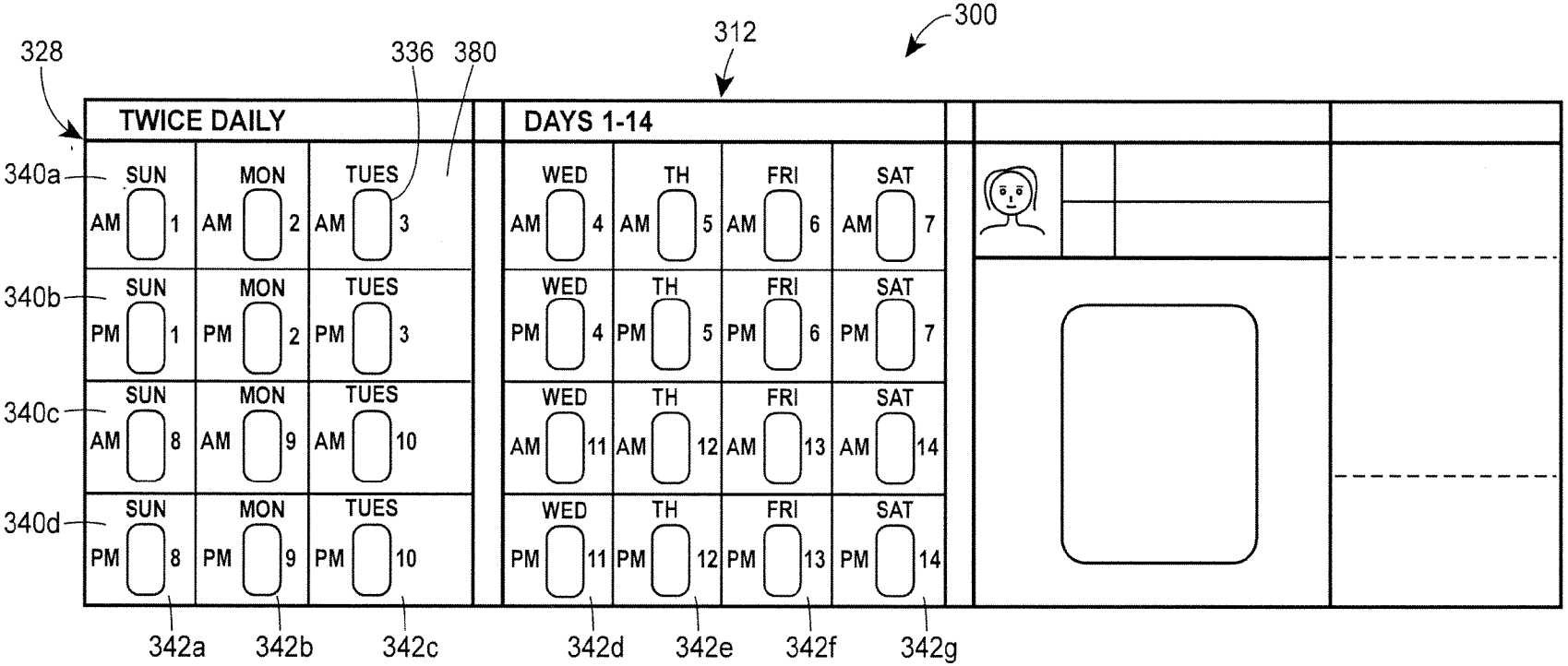
FIG. 7 is a plan view of another alternative embodiment of a product package constructed in accordance with the principles of the present invention including a multi-dose blister card adapted for storing product for ingestion twice daily for the first fourteen days of a thirty-day prescription.
Figure 8:
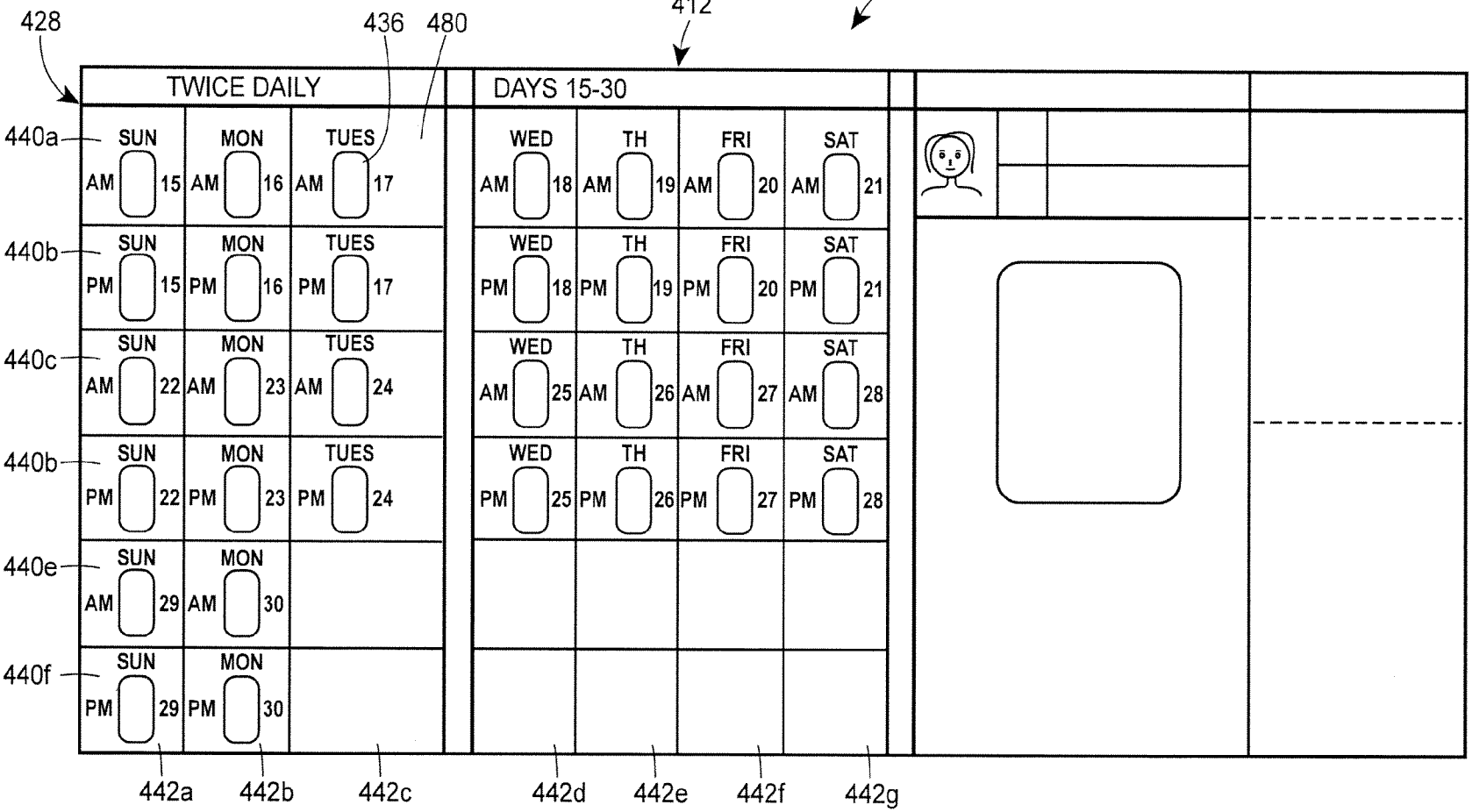
FIG. 8 is a plan view of a product package constructed in accordance with the principles of the present invention to complement the product package of FIG. 7 and including a multi-dose blister card adapted for storing product for ingestion twice daily for the last sixteen days of a thirty-day prescription.

For example, FIGS. 7 and 8 illustrate one embodiment of complementary product packages 300, 400 constructed in accordance with the principles of the present invention that are adapted to store a thirty-day prescription to be ingested twice-daily. Specifically, the product package 300 depicted in FIG. 7 includes the first fourteen days of the prescription and the product package 400 depicted in FIG. 8 includes the last sixteen days of the prescription. The remainder of the product packages 300, 400 are similar to the product package 10 depicted in FIGS. 1 and 2.

With reference to FIG. 7, the product package 300 includes a multi-dose blister card 312 having a matrix 328 of twenty-eight cells 380. Each cell 380 includes a blister 336. The cells 380 are arranged in first through fourth rows 340*a*-340*d* and first through seventh columns 342*a*-342*g*. Each day of the first fourteen days of the prescription includes two blisters 336, one for the morning, which is marked "AM" and one for the evening, which is marked "PM." Accordingly, as depicted, the first row 340*a* of the matrix 328 includes products for ingestion during the morning, i.e., "AM," of the first through seventh days of the prescription, i.e., Sunday through Saturday of the first week. The numbered day is marked on the cell 380 adjacent to the blister 336. The second row 340*b* of the matrix includes products for ingestion during the evening, i.e., "PM," of the first seven days of the prescription. Similarly, the third row 340*c* of the matrix 328 includes products for ingestion during the morning, i.e., "AM," of the eighth through fourteenth days of the prescription, i.e., Sunday through Saturday of the second week, and the fourth row 340*d* of the matrix 328 includes products for ingestion during the evening, i.e., "PM," of the eighth through fourteenth days of the prescription, i.e., Sunday through Saturday of the second week. In one embodiment, the first and third rows 340*a*, 340*c* can be colored differently from the second and fourth rows 340*b*, 340*d* to indicate to the patient what cells 380 are to be ingested at what times of the day. For example, the first and third rows 340*a*, 340*c* may include yellow cells 380, for example, indicating the morning, while the second and fourth rows 340*b*, 340*d* may include black cells 380, for example, indicating the evening. At the end of the first fourteen days of the prescription, the patient would then move on to the product package 400 depicted in FIG. 8.

As mentioned, the product package 400 is adapted to carry product to be ingested for the last sixteen days of a thirty-day prescription. The product package 400 therefore includes a multi-dose blister card 412 having a matrix 428 of forty-two cells 480 in total. The cells 480 are arranged in first through sixth rows 440*a*-440*f* and first through seventh columns 442*a*-442*g*. A majority of the cells 480 include a blister 436 for containing product to be ingested. Specifically, each cell 480 in the first through fourth rows 440*a*-440*d* include blisters 436, while only the first and second columns 442*a*, 442*b* in the fifth and sixth rows 440*e*, 440*f* include blisters 436.

Similar to the product package 300 depicted in FIG. 7, the product package 400 includes two blisters 436 for each day, one for the morning, which is marked "AM" and one for the evening, which is marked "PM." Accordingly, as depicted, the first row 440*a* of the matrix 428 includes products for ingestion during the morning, i.e., "AM," of the fifteenth through twenty-first days of the prescription, i.e., Sunday through Saturday of the third week of the prescription. The numbered day is marked on the cell 480 adjacent to the blister 436. The second row 440*b* of the matrix 428 includes products for ingestion during the evening. i.e., "PM," of the fifteenth through twenty-first days of the prescription. Similarly, the third row 440*c* of the matrix 428 includes products for ingestion during the morning, i.e., "AM," of the twenty-second through twenty-eighth days of the prescription, i.e., Sunday through Saturday of the fourth week, and the fourth row 440*d* of the matrix 428 includes products for ingestion during the evening of the twenty-second through twenty-eighth days of the prescription, i.e., Sunday through Saturday of the fourth week. Finally, only the first and second columns 442*a*, 442*b* of the fifth and sixth rows 440*e*, 440*f* of the matrix 428 include products for ingestion during the morning, i.e., "AM," and evening, i.e., "PM," respectively of the twenty-ninth and thirtieth days of the prescription, i.e., Sunday and Monday of the fifth, and final, week.

Similar to that described above with respect to the product package 300 depicted in FIG. 7, the first, third, and fifth rows 440*a*, 440*c*, 440*e* of the product package 400 depicted in FIG. 8 can be colored differently from the second, fourth, and sixth rows 440*b*, 440*d*, 440*f* to indicate to the patient what cells 480 are to be ingested at what times of the day. For example, the first, third, and fifth rows 440*a*, 340*c*, 440*e* may include yellow cells 480, for example, indicating the morning, while the second, fourth, and sixth rows 440*b*, 440*d*, 440*f* may include black cells 480, for example, indicating the evening.

As the remainder of the configuration of the product packages 300, 400 depicted in FIGS. 7 and 8 are generally identical to the product package 10 depicted in FIGS. 1 and 2, it should be appreciated that the product packages 300, 400 close in the same tri-fold manner described with reference to FIG. 2.

Figure 9:
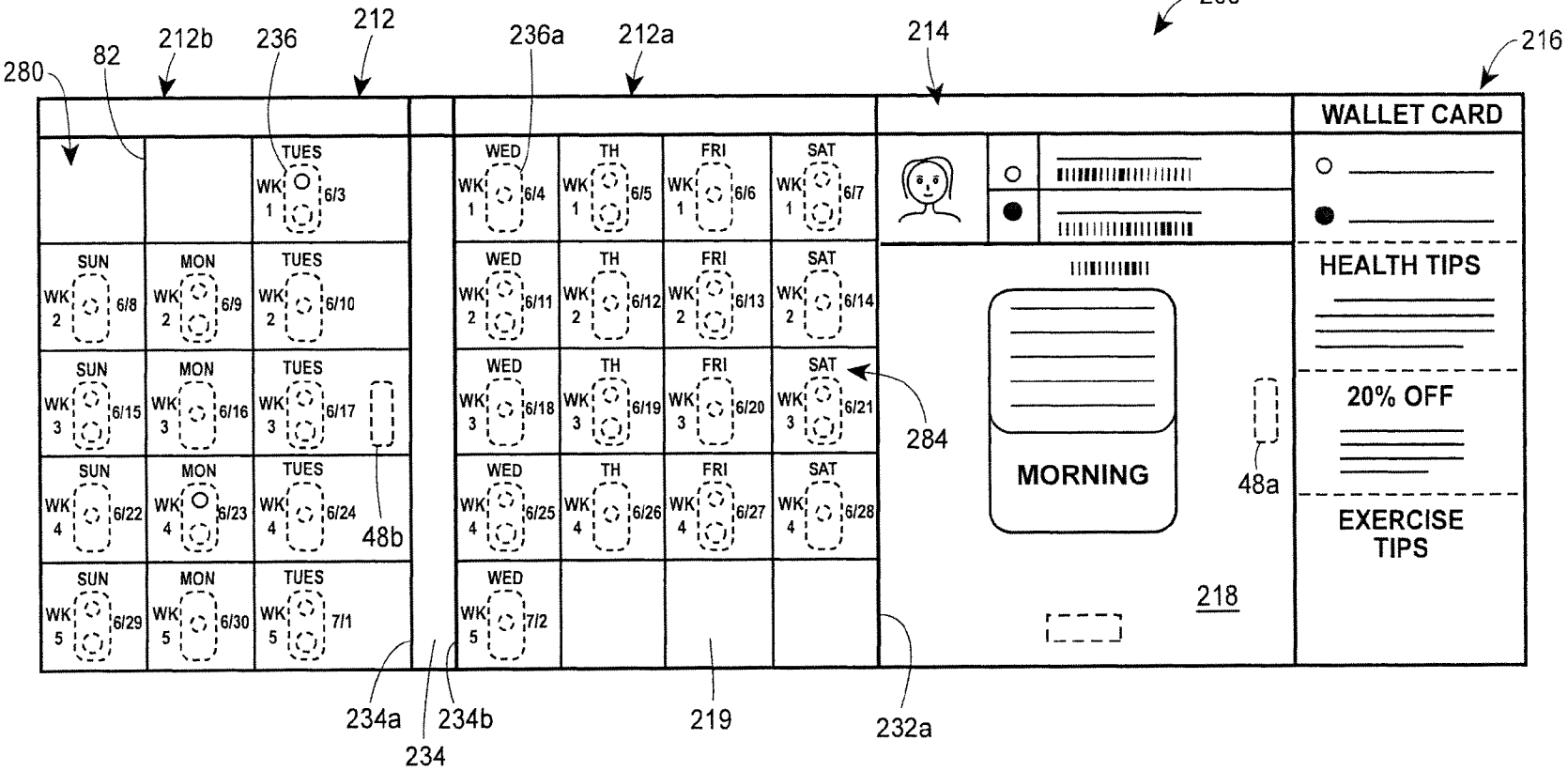
FIG. 9 is a plan view of another alternative embodiment of a product package constructed in accordance with the principles of the present invention including a multi-dose blister card.
Figure 10:
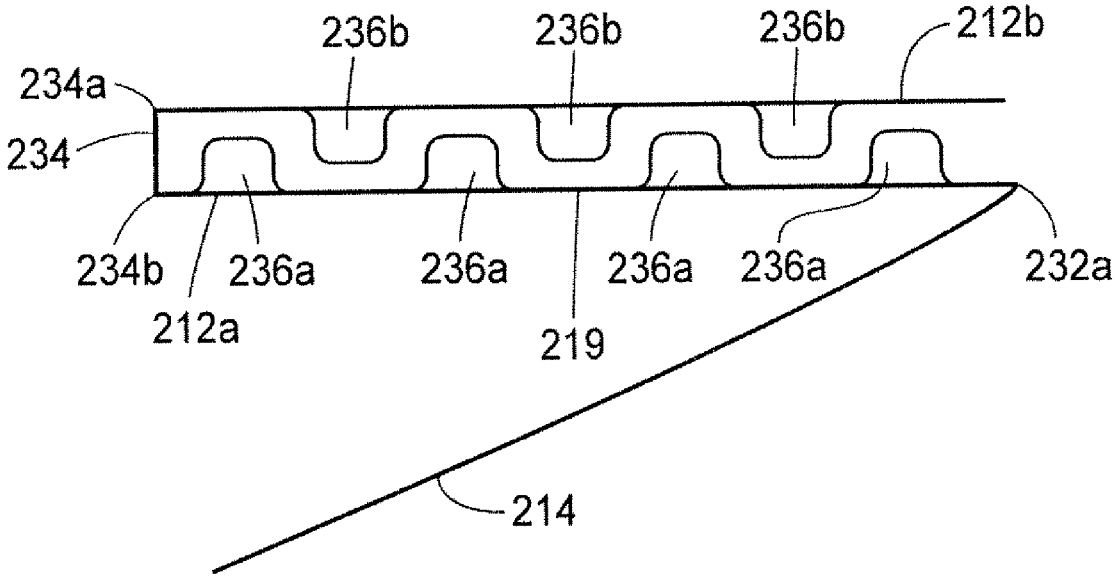
FIG. 10 is an end view of the product package of FIG. 7 in a partially closed configuration.

Referring now to FIGS. 9 and 10, yet another alternative embodiment of a product package 200 constructed in accordance with the principles of the present invention is disclosed. The product package 200 depicted in FIG. 9 is similar to the product package 10 depicted in FIG. 1 in that it is arranged and configured to accommodate tablets for ingestion at a particular time of day, e.g., "Morning," for an entire thirty-day prescription. The product package 200 includes a multi-dose blister card 212, a cover 214, and an optional information center 216. The cover 214 and optional information center 216 of the product package 200 in FIG. 7 are identical to the cover 14 and information center 16 of the product package 10 in FIG. 1, and therefore, the details will not be repeated.

The multi-dose blister card 212 of the product package 200 depicted in FIG. 9 is similar to the multi-dose blister card 12 of the package 10 of FIG. 1 in that it includes a first blister card portion 212*a* and a second blister card portion 212*b*. Each blister card portion 212*a*, 212*b* carries an appropriate number of blisters 236*a*, 236*b*. However, as depicted in FIG. 9, when the product package 200 is open, the first and second blister card portions 212*a*, 212*b* are disposed such that the blisters 236*a*, 236*b* face away from an inside surface 218 of the cover 214. So configured, a backing material 219 that is adhered to the back-sides of the blister card portions 212*a*, 212*b* to seal the blisters 236*a*, 236*b* faces in the same direction of the inside surface 218 of the cover 214. The backing material 219 is divided into cells 280 representative of units containing one blister 236*a*, 236*b*. The cells 280 may be detached from the multi-dose blister card 212 in a manner identical to the cells 80 described above with reference to FIG. 1, for example.

As illustrated, each cell 280 of backing material 219 includes indicia 284 identical to the indicia 84 provided on the multi-dose blister card 12 depicted in FIG. 1. In FIG. 9, the backing material 219 encloses the blisters 236*a*, 236*b* around a perimeter of the blisters 236*a*, 236*b*, which are indicated with the dashed, hidden lines. Thus, the backing material 219 is adapted to tear about the perimeters of the blisters 236*a*, 236*b*. In alternative embodiments, the backing material 219 may be adapted to tear about an area that is actually larger than the perimeter of the blisters 236*a*, 236*b*. So configured, the backing material 219 may be cleanly removed from interfering with the blisters 236*a*, 236*b* when pushed open.

The multi-dose blister card 212 depicted in FIG. 9 further includes a spine 234 disposed between and connecting the first and second blister card portions 212*a*, 212*b*. More particularly, the spine 234 includes a first seam 234*a* and a second seam 234*b*. The first seam 234*a* connects the second blister card portion 212*b* to the spine 234. The second seam 234*b* connects the first blister card portion 212*a* to the spine 234. The first blister card portion 212*a* is connected to the cover 214 at a seam 232*a*.

Thus, to close the product package 200, the second blister card portion 212*b* folds along the first seam 234*a* of the spine 234, as depicted in FIG. 10. Additionally, the spine 234 folds along the second seam 234*b*. So folded, the blisters 236*b* carried by the second blister card portion 212*b* become nested with or interleaved between the blisters 236*a* carried by the first blister card portion 212*a*. Finally, the cover 214 folds along the seam 232*a* relative to the first and second blister card portions 212*a*, 212*b* to lay against the backing material 219 carried by the first blister card portion 212*a*.

While the embodiment of the product package 200 depicted in FIGS. 9 and 10 has been described as having a layout resembling the layout of the product package 10 depicted in FIG. 1, the same principles may be applied to the layout of the product package 100 depicted in FIG. 5 and/or FIGS. 7 and 8. For example, instead of being configured to accommodate tablets for ingestion for a particular time of day for an entire thirty-day prescription, the product package 200 may be arranged and configured to accommodate tablets for ingestion at all times of the day for the first eight days of a thirty-day prescription, for example, or twice daily for a first fourteen day period and a second sixteen day period. In further alternative embodiments, the product package 200 disclosed with reference to FIGS. 9 and 10 may be arranged and configured to accommodate tablets for ingestion for generally any prescription.

Furthermore, it should be appreciated that the product packages 10, 100, 200, 300, 400 disclosed herein as examples of the present invention provide highly customizable product packages 10, 100, 200, 300, 400 for presenting products such as prescription medications for ingestion by patients in a manner which prevents confusion. Specifically, the arrangement of the identification labels on the covers 14, 114, 214 are fully customizable including the photographic information of both the patient and the actual medications. In fact, in one embodiment, a patient may be able to personalize the identification labels 20*a*, 20*b* presented on the cover 14, 114, 214 of the product package 10, 100, 200, 300, 400 at a kiosk or other customer-usable station located at the physician's office, or the pharmacist, for example, to input personal information, select colors for the cover, select a decorative theme for the cover and/or the child-resistant storage box 54, 68 for containing the cover, as depicted in FIGS. 3 and 4, for example. The kiosk may also include a digital camera, for example, to enable the customer to take his/her own photograph to be utilized on the cover 14, 114, 214. The kiosk may include a keyboard enabling the patient to enter a name, nickname, or other pseudonym to be printed on one of a of the product package 10, 100, 200, 300, 400, for example, along with an icon establishing the time of day corresponding to that particular product package 10, 100, 200, 300, 400.

In other embodiments, the patient, or the pharmacist, may customize the colors of the product packages 10, 200, 200, 300, 400. For example, the multi-dose blisters cards 12, 112, 212, 312, 412 the backing materials 219, or the entire product packages 10, 100, 200, 300, 400 may be colored differently for different times of the day including pink for all morning packages, yellow for all noon packages, blue for all evening packages, and black for night packages. Other customizable color schemes representative of different times, or weeks, or to distinguish product packages for multiple patients within a single residence/location, or any other information may be envisioned and are intended to be within the scope of the invention.

Further yet, it should be appreciated that the product packages 10, 100, 200, 300, 400 of the present invention advantageously provide a compact multi-dose blister card 12, 112, 212, 312, 412 configuration, which allows patients to store and/or carry such product package 10, 100, 200, 300, 400 easily within a purse, briefcase, or coat pocket. In one embodiment, the fully folded product packages 10, 100, 200, 300, 400 may be approximately 5.5" in width and approximately 8.5" in height. However, depending on the specific prescriptions provided to any patient, the product packages 10, 100, 200, 300, 400 may have generally any folded dimensions.

Figure 11:
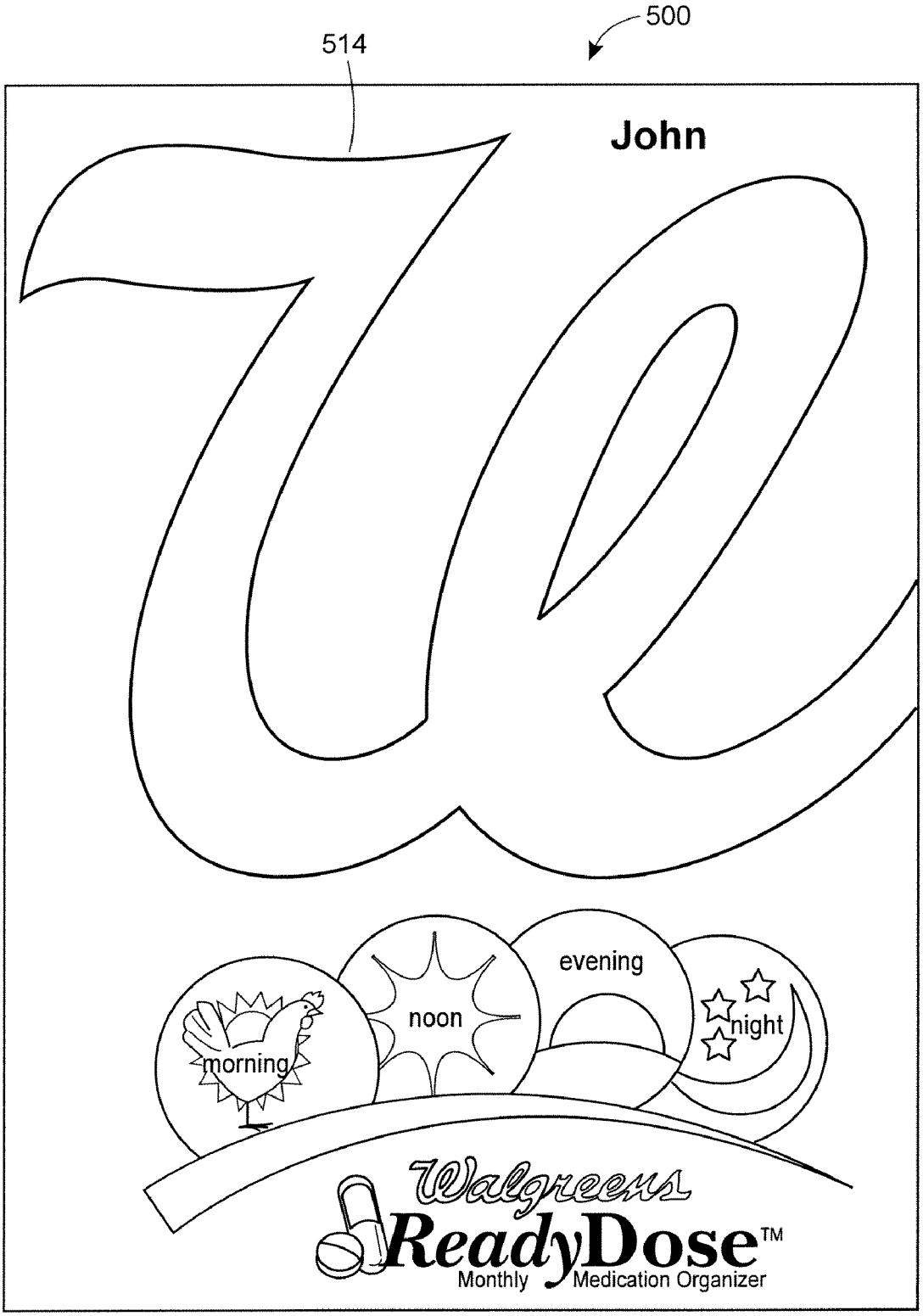
FIG. 11 is a front plan view of a cover of a prototype product package constructed in accordance with the principles of the present invention.
Figure 12:
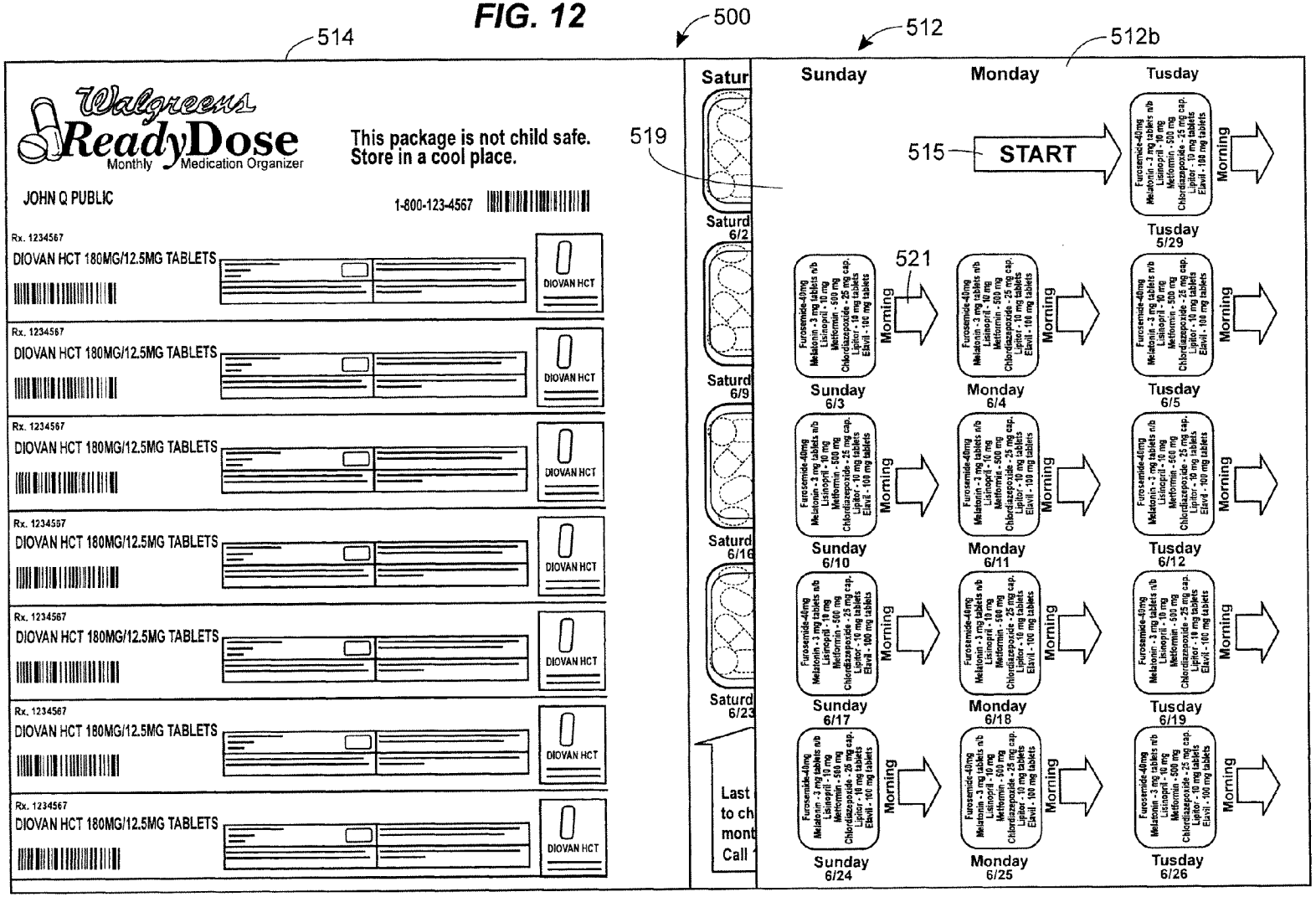
FIG. 12 is a front plan view of the prototype product package similar to the product package schematically illustrated in FIGS. 1 and 2 in a partially opened position.
Figure 13:
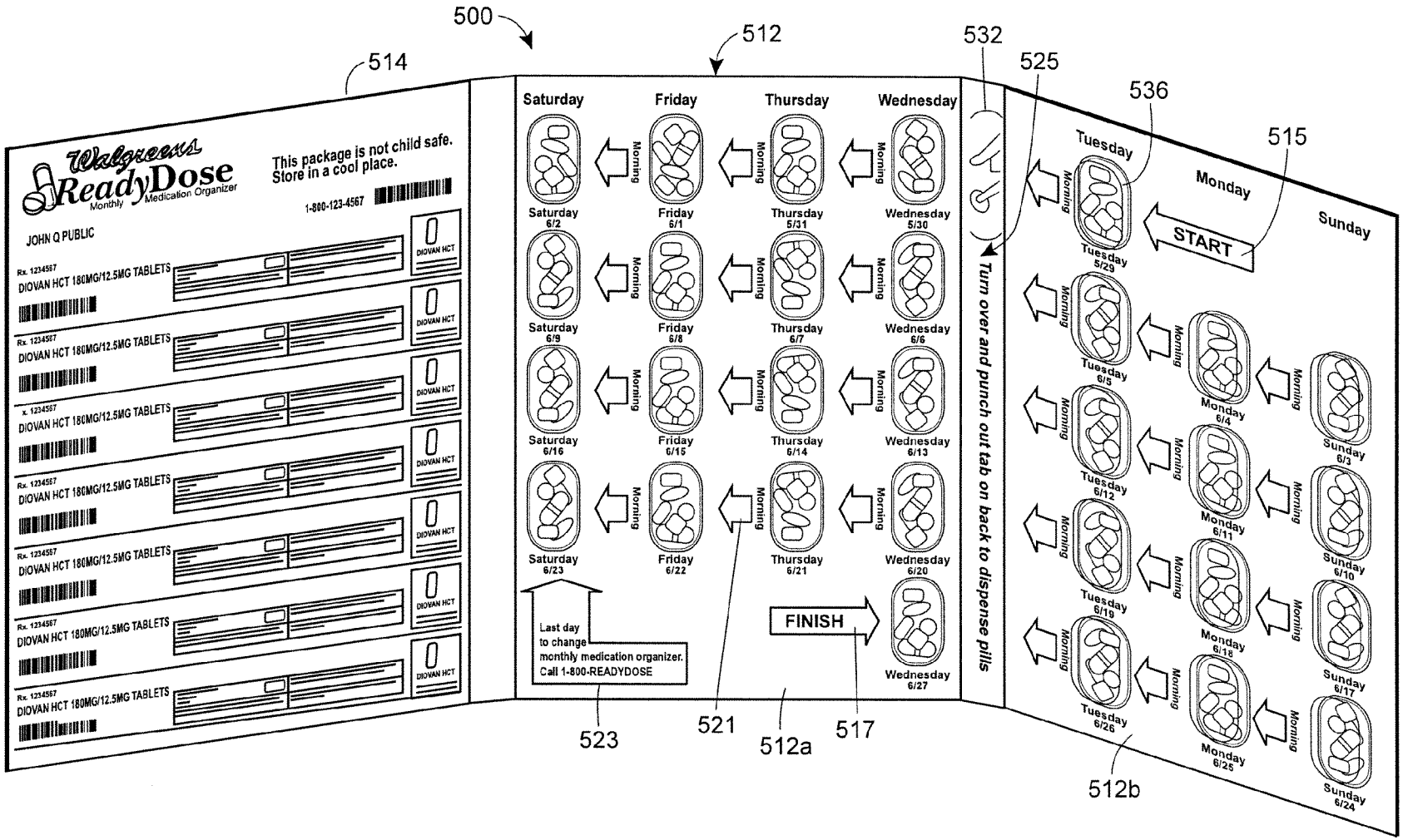
FIGS. 13 and 14 are perspective and plan views, respectively, of the prototype product package of FIG. 12 in an opened position.
Figure 14:
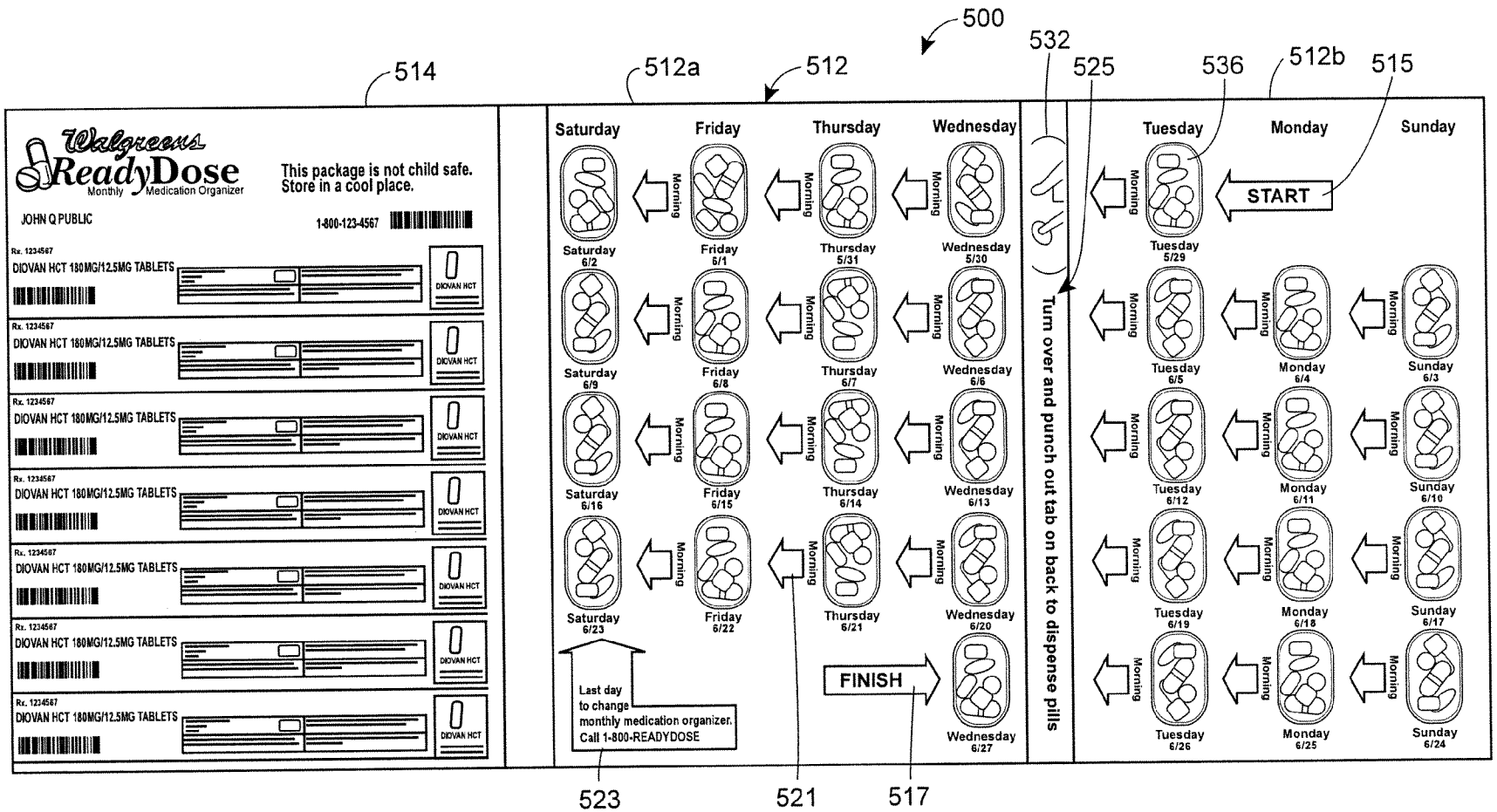
Figure 15:
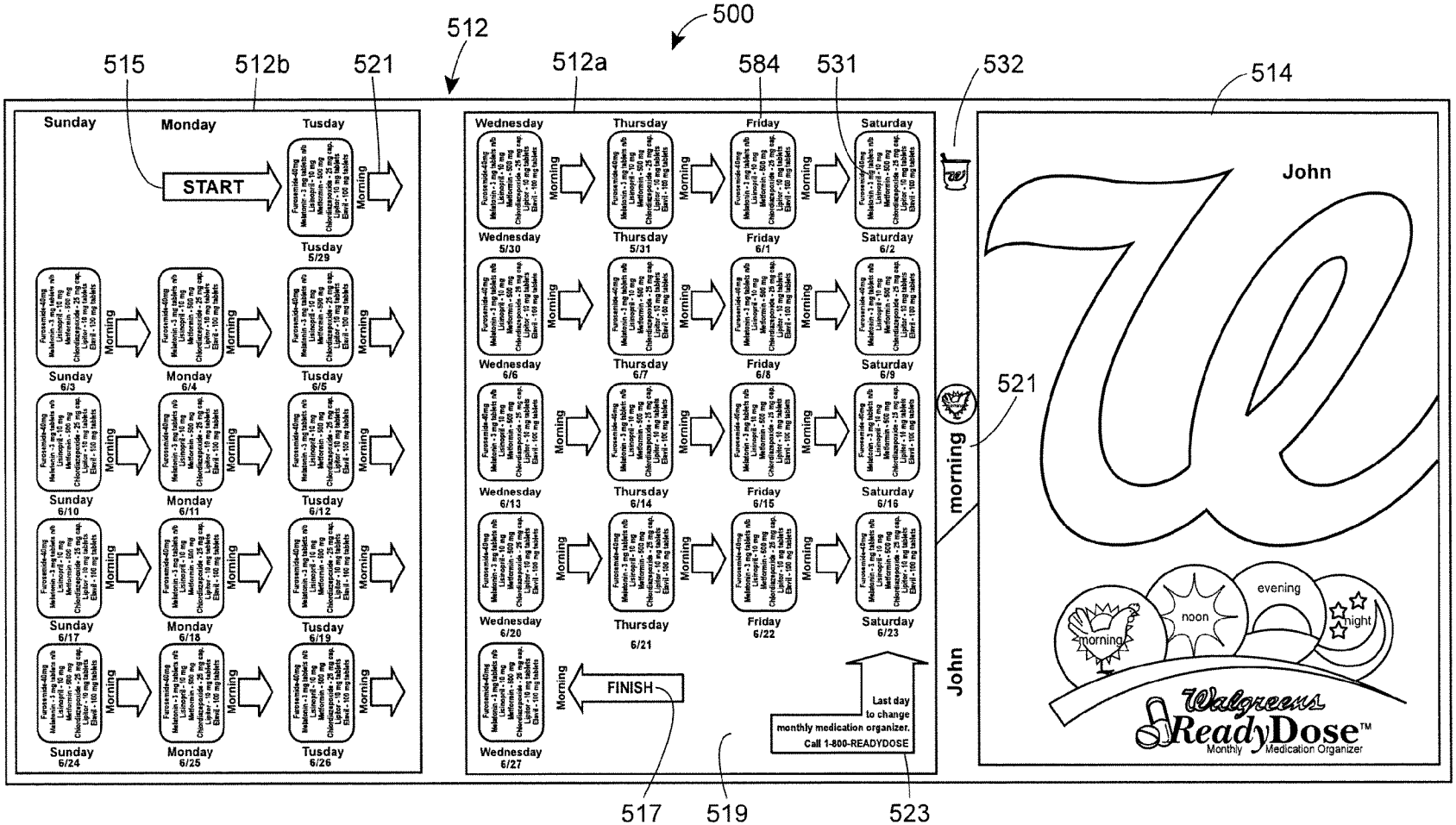
FIG. 15 is a rear plan view of the prototype product package of FIG. 12.
Figure 16:
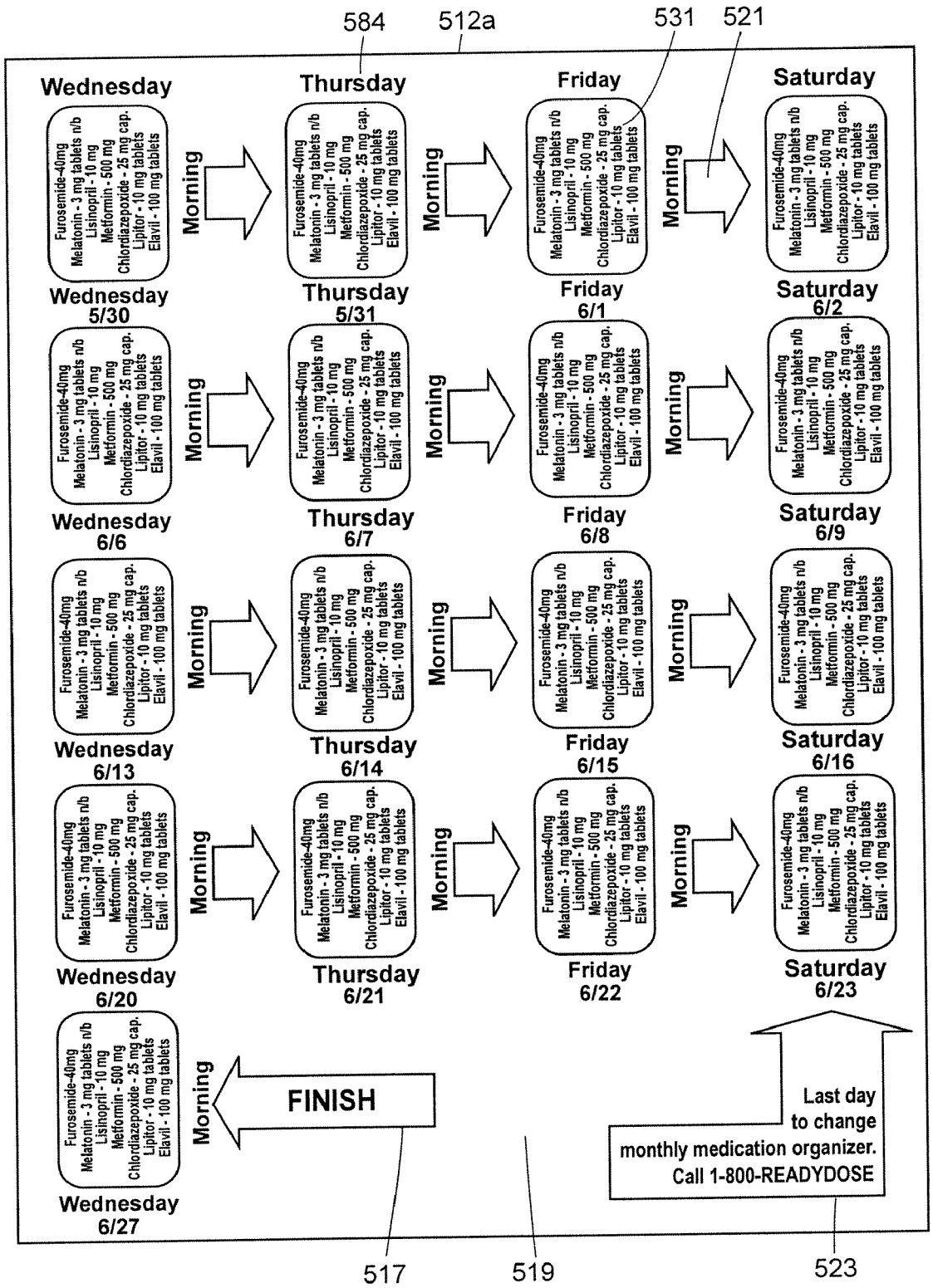
FIG. 16 is a detailed plan view of the rear of the center portion of the prototype product package depicted in FIG. 15.

While FIGS. 1-10 have thus far schematically illustrated various embodiments of product packages 10, 100, 200, 300, 400 constructed in accordance with principles of the present invention, FIGS. 11-16 illustrate one tri-fold prototype product package 500 generally based on the configuration of the product package 10 depicted in FIGS. 1 and 2. FIG. 11 illustrates a front-side of a cover 514 of the product package 500. In general, the front-side of the cover 514 includes the patient's name "John," a corporate logo, and some product information. FIG. 12 illustrates the tri-fold prototype product package 500 in a partially open configuration. Specifically, the cover 514 is opened to expose a rear-side of a second blister card portion 512*b* of a multi-dose blister card 512. FIGS. 13 and 14 provide various views of the product package 500 fully opened exposing blisters 536 carried by the second blister card portion 512*b*, as well as a first blister card portion 512*a* of the multi-dose blister card 512. The blisters 536 of the multi-dose blister card 512 of the product package 500 are arranged in a manner similar to the blisters 36 of the multi-dose blister card 12 of the product package 10 described with reference to FIG. 1. FIG. 15 illustrates a back-side view of the product package 500, showing a backing material 519 adhered to the backs of the blister card portions 512*a*, 512*b*, and therefore, sealing the blisters 536. FIG. 16 illustrates a detailed view of the back-side of the first blister card portion 512*a* of the blister card 512.

As mentioned, the product package 500 is similar to the package 10 depicted in FIGS. 1 and 2. The product package 500, however, is also illustrated as including a "START" arrow indicating what blister 536 contains the first product to be ingested, and a "FINISH" arrow 517 indicating what blister 536 contains the last product to be ingested. Moreover, the product package 500 includes arrows 521 between each blister 536, to indicate to the patient what blister 536 contains the next product to be ingested. All of the arrows 515, 517, and 521 are provided both on the front-sides of the multi-dose blister cards 512, as depicted in FIGS. 13 and 14, as well as on the backing material 519, as depicted in FIG. 15. Further still, the product package 500 includes a change indicator 523, which is illustrated in FIGS. 13-16. The change indicator 623 indicates to the patient when the last day to change the monthly medication organizer. In the disclosed embodiment, the change indicator 523 also includes a telephone number for the patient to call to change the medication organizer, as illustrated in FIG. 16. Further yet, as depicted in FIGS. 13 and 14, the product package 500 includes a spine 532 disposed between the cover 514 and the first blister card portion 512*a*. The spine 532 of the disclosed prototype includes a descriptor 525 that describes to the patient how to open each blister 536 to retrieve the products stored therein. Finally, as illustrated in FIG. 16, the opposite side of the spine 532 may include the patient's name, "John," a time stamp 527, and a corporate logo. Additionally, as depicted in FIGS. 15 and 16, the backing material 519 for the product package 500 includes indicia 584 indicating when to take each product stored in each blister 528, as well as information 531 specific to the product stored in each blister 536.

Thus far, each of the product packages 10, 100, 200, 300, 400, 500 described herein have included generally rectangular individual blister cards, or cells 80, 180, 280, 380, 480, 580 carrying the individual blisters 36, 136, 236, 336, 436, 536. These generally rectangular cells 80, 180, 280, 380, 480, 580 accordingly, have generally square corners. That is, the sides of the cells 80, 180, 280, 380, 480, 580 intersect one another at approximately ninety-degrees (90°). In some alternative embodiments, the cells 80, 180, 280, 380, 480, 580 can be shaped differently.

Figure 17:
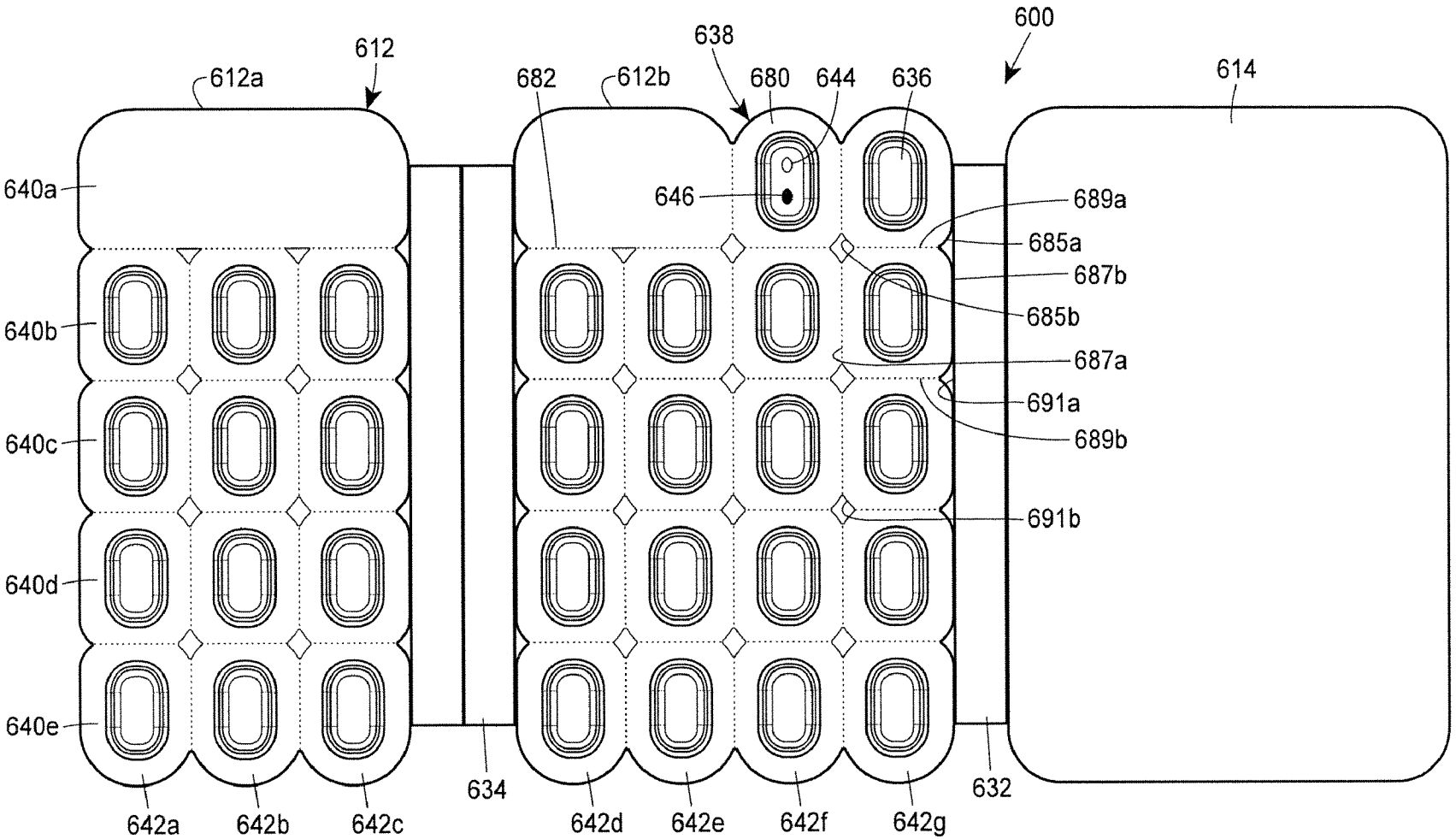
FIG. 17 is a plan view of yet another alternative embodiment of a product package constructed in accordance with the principles of the present invention including a multi-dose blister card.

For example, FIG. 17 depicts an alternative embodiment of a product package 600 constructed in accordance with the principles of the present invention, and which includes a matrix 638 of cells 680, where each cell 680 has rounded corners 685*a*, 685*b*. Otherwise, the product package 600 depicted in FIG. 17 can be generally identical to the product package 10 described above with reference to FIGS. 1 and 2 and can include any and all of the features described above with reference to FIGS. 1 and 2, and/or any of the features described above with reference to FIGS. 5-16.

For example, the product package 600 includes a multi-dose blister card 612 and a cover 614. The multi-dose blister card 612 includes a first blister card portion 612*a* and a second blister card portion 612*b*. The product package 600 additionally includes a first spine 632 and a second pine 634. The first spine 632 connects the first blister card portion 612*a* to the cover 614, and the second spine 634 connects the second blister card portion 612*b* to the first blister card portion 612*a*.

In FIG. 17, the first and second blister card portions 612*a*, 612*b* define the cells 680, each of which carries a blister 636 for storing the one or more products 644, 646. The cells 680 are separated by perforated seams 682. So configured, the seams 682 define the matrix of cells 680 as being arranged in first through fifth rows 640*a*-460*e* and first through seventh columns 642*a*-642*g*. As mentioned, each cell 680 includes generally rounded corners 685*a*, 685*b*. Each cell 680 also includes opposing side edges 687*a*, 687*b* and opposing top and bottom edges 689*a*, 689*b*. The opposing side edges 687*a*, 687*b* of each cell 680 are generally linear and parallel to each other. The configuration of the top and bottom edges 689*a*, 689*b* of each cell 680 depends on the location of each cell 680 relative to the remainder of the matrix 638.

For example, each of the cells 680 located within the second through fourth rows 640*b*-640*d* of the matrix 638 include top and bottom edges 689*a*, 689*b* that are generally linear and parallel to each other. The cells 680 located in the first row 640*a* of the matrix 638, however, include top edges 689*a* that are semi-circular, and bottom edges 689*b* that are generally linear. Similarly, the cells 680 located in the fifth row 640*e* of the matrix 638 include bottom edges 689*b* that are semi-circular, and top edges 689*a* that are generally linear. In alternative embodiments, the top edges 689*a* of the cells 680 in the first row 640*a* and the bottom edges 689*b* of the cells 680 in the fifth row 640*e* can be generally linear and parallel to the respective top and bottom edges 689*a*, 689*b*.

Thus, as configured, the rounded corners 685*a*, 685*b* of the cells 680 define a plurality of openings 691*a*, 691*b* in the multi-dose blister card 612. The openings 691*a*, 691*b* are generally located where the side edges 687*a*, 687*b* would otherwise intersect the top and bottom edges 689*a*, 689*b* of the cells 680. The shape of each opening 691*a*, 691*b* depends on its location. For example, the openings 691*a* that are disposed adjacent to one of the first and second spines 632, 634 of the product package 600 are generally triangular-shaped, while the openings 691*b* that are disposed directly between the columns 642*a*-642*g* of cells 680 are generally diamond-shaped. In the embodiment disclosed in FIG. 17, the cells 680 located in the first through fifth columns 642*a*-642*e* of the first row 640*a* do not carry blisters 636. Accordingly, these cells 680 are not subdivided with seam 682, and as such, do not necessarily have rounded corners 685*a*, 685*b*. The openings that abut these cells 680 are therefore, also illustrated as triangular-shaped. With this configuration, a patient can remove all of the cells 680 located in the first three columns 642*a*-642*c* of the first row 640 simultaneously, and all of the cells 680 located in the fourth and fifth column 642*d*, 642*e* of the first row 640*a* simultaneously.

While the openings 691*a*, 691*b* are described as being generally triangular-shaped and generally diamond-shaped, it should be appreciated that the sides of the openings 691*a*, 691*b* are defined by the rounded corners 685*a*, 685 of the cells 680 and, as such, the openings 691*a*, 691*b* are not traditional triangles and diamonds, but rather have sides with inwardly curved, concave, profiles.

While the cells 680 are described as including rounded corners 685*a*, 685*b*, thereby defining generally triangular and diamond-shaped openings 691*a*, 691*b*, one of ordinary skill in the art can appreciate that the corners of the cells 680 need not be rounded to define openings. For example, in some alternative embodiments, the corners of the cells 680 may simply be cut-off, or chamfered. As such, the triangular and diamond-shaped openings 691*a*, 691*b* could resemble true triangles and diamonds. Openings may have any other shape are therefore also intended to be within the scope of the present disclosure.

Similar to that described above with reference to the package 10 depicted in FIGS. 1 and 2, the product package 600 depicted in FIG. 17 is adapted to be folded similar to a tri-fold pamphlet, or wallet, for example, to advantageously reduce its overall storage size. The first and second spines 632, 634 are generally identical to the first and second spines 32, 34 of the product package 10 depicted in FIG. 1, with one exception being that the second spine 634 of the product package 600 depicted in FIG. 17 is twice the width of the first spine 632. This is to facilitate the nesting configuration of the blisters 636 when the package 600 is folded closed. The first and second spines 32, 34 of the product package 10 depicted in FIG. 1 are the same width because the cells 80 in the third column 42*c* thereof are wider than the remaining cells 80 to facilitate the tri-fold nesting. It should therefore be appreciated that an alternative embodiment of the product package 10 depicted in FIG. 1 can be constructed to include a second spine 34 similar to the second spine 634 depicted in FIG. 17, and the product package 600 depicted in FIG. 17 can be constructed to include a second spine 634 similar to the second spine 34 depicted in FIG. 1.

With the multi-dose blister card 612 configured as depicted in FIG. 17, the rounded corners 685*a*, 685*b* eliminate the sharp ninety-degree corners of the previously described embodiments and also assist in the removal of each cell 680 from the remainder of the multi-dose blister card 612. That is, the openings 691*a*, 691*b* effectively reduce the amount of material connecting each cell 680 to its adjacent cell(s) 680, thereby requiring less effort to tear a cell 680 along the perforated seams 682. Additionally, the incorporation of rounded corners 685*a*, 685*b* reduces any tendency to inadvertently tear one or more adjacent cells 680 when removing a specific cell 680 from the multi-dose blister card 612.

Figure 18:
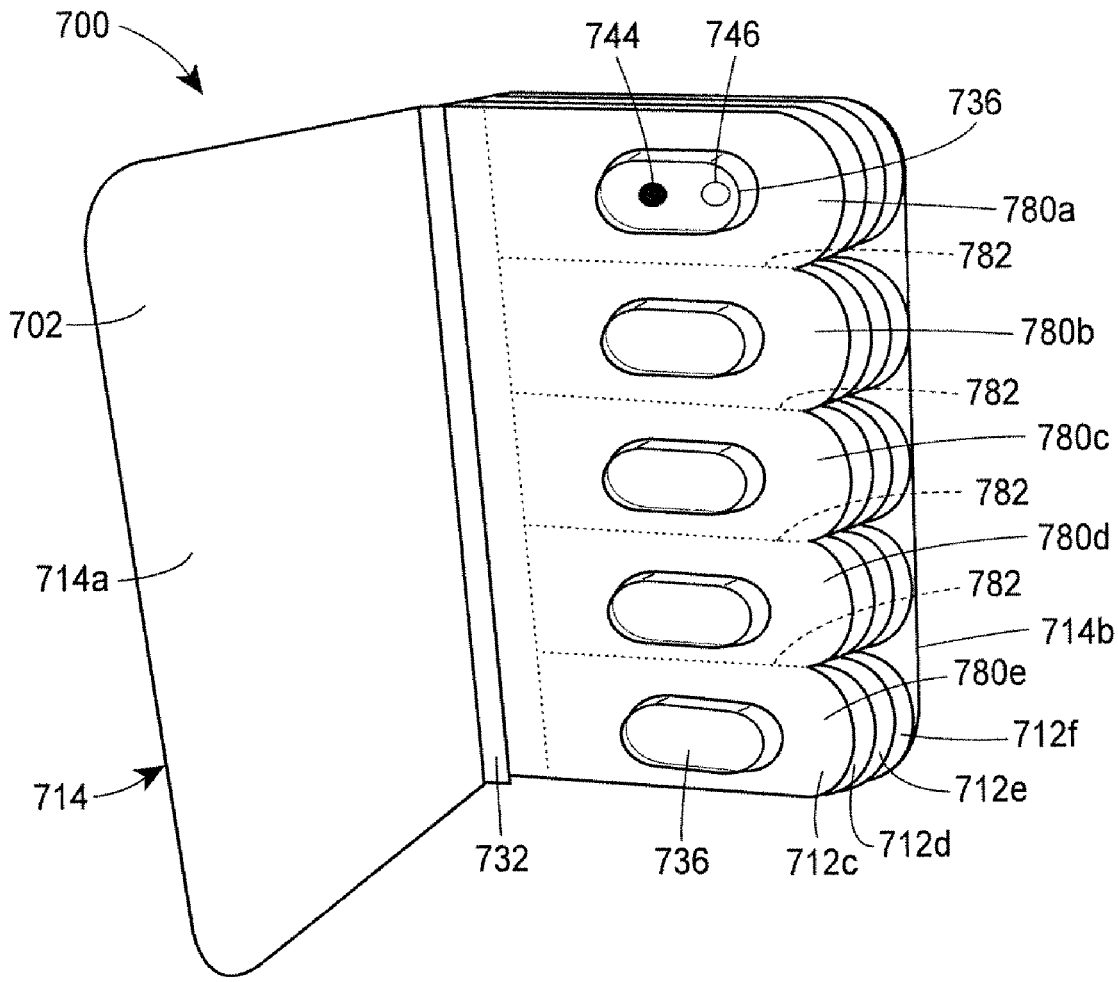
FIG. 18 is a perspective view of yet another alternative embodiment of a product package constructed in accordance with the principles of the present invention including a pillbook.

While the present disclosure has thus far described tri-fold-type product packages, multi-dose blister cards can also be stored in other configurations. For example, FIG. 18 depicts one embodiment of a product package 700 that includes a pillbook 702. The pillbook 702 generally includes a binder 714 and a plurality of multi-dose blister cards 712. The binder 714 includes a front cover 714*a*, a back cover 714*b*, and a spine 732. Each of the plurality of multi-dose blister cards 712 can be constructed of materials and in a fashion similar to the blister cards 12, 112, 212, 312, 412, 512, 612 described above, and therefore the details will not be repeated. The blister cards 712 of the embodiment depicted in FIG. 18 are removably attached to the spine 732 of the binder 714 with a coupler mechanism such as an adhesive, e.g., a glue. So configured, a patient can remove one or more of the multi-dose blister cards 712 from the binder 714 to be carried away. In an alternative embodiment, each of the plurality of multi-dose blister cards 712 can be removable, and re-attachable, to the spine 732 with an adhesive, or other means such as a hook and loop fastener, e.g., Velcro®, for example.

Figure 19:
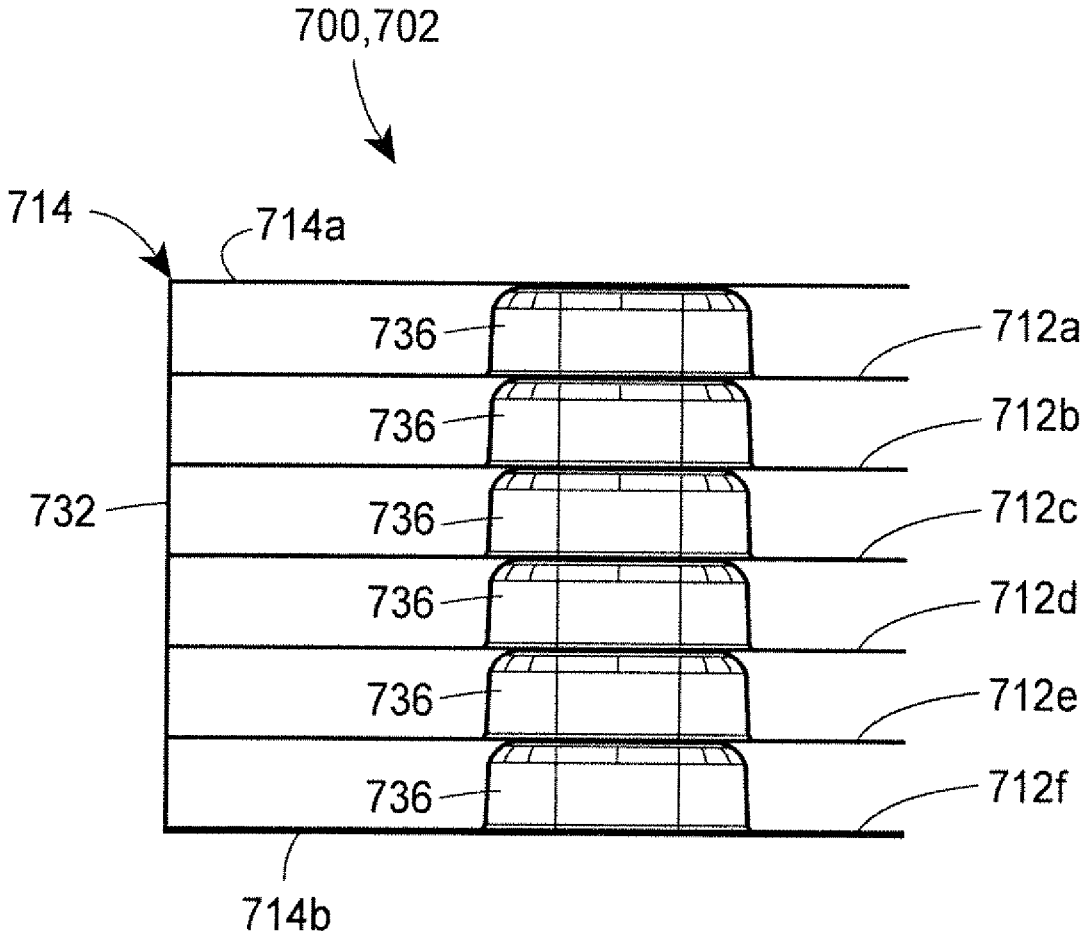
FIG. 19 is an end view of the product package of FIG. 18 including the pillbook in a closed configuration.

In the depicted embodiment, the pillbook 702 is adapted to contain six multi-dose blister cards 712*a*-712*f* adapted to be stacked for storage within the binder 714, as depicted in FIG. 19. In FIG. 18, the first and second blister cards 712*a*, 712*b* have been removed from the binder 714. In one embodiment, the closed pillbook 702 can have a thickness of approximately 3.25", a height of approximately 6.85", and a width of approximately 4.25".

As shown in FIG. 18, each blister card 712 can include five individual cards, or cells 780*a*-780*e*, arranged in a single column. The cells 780 are separated from each other by perforated seams 782 and carry blisters 736 for storing one or more products 744, 746 such as medications, for example. The pillbook 702 therefore contains thirty cells 780 and thirty blisters 736 to accommodate one or more thirty-day prescriptions, for example, wherein each blister 736 contains all of the medications that an individual prescribed the pillbook 702 is to ingest at any given time on a particular day. For example, in one embodiment, the pillbook 702 can contain the products 744, 746 that an individual is to ingest during the morning, everyday, for thirty days. In this regard, the binder 714 of the pillbook 702 can include indicia, such as "AM," indicating that the products 744, 746 stored therein are for morning ingestion. Additionally, each of the cells 780 can include indicia indicating the day of the week, the day of the prescription, the date, or any other information informing a patient when to ingest the stored product(s) 744, 746. Should the individual also be prescribed one or more medications for ingestion at different times of the day, e.g., afternoon, evening, and/or night, the individual would be prescribed additional pillbooks 702 for each specific time of day.

While the pillbook 702 described with reference to FIGS. 18 and 19 includes multi-dose blister cards 712*a*-712*f* removably attached to the spine 732 of the binder 714 with an adhesive, for example, alternative embodiments can include alternative means of fixation, as mentioned.

For example, FIGS. 20-23 depict one alternative embodiment of a product package 800 constructed in accordance with the principles of the present application that includes a pillbook 802 comprising a binder 814 and a plurality of multi-dose blister cards 812. The binder 814 includes a front cover 814*a*, a back cover 814*b*, and a spine 832. The multi-dose blister cards 812 are removably, and re-attachably, connected to the spine 832 of the binder 814 via a coupler mechanism 806.

Figure 20:
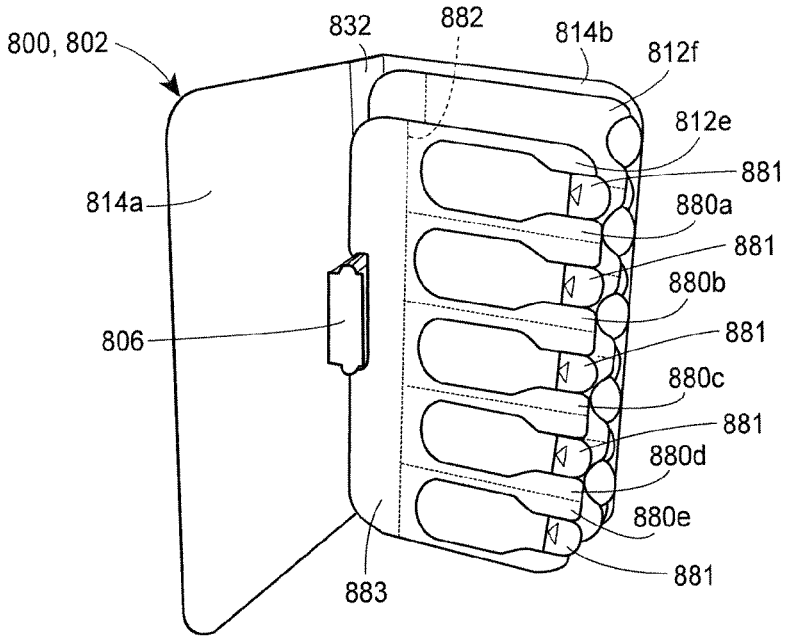
FIG. 20 is a perspective view of still another alternative embodiment of a product package constructed in accordance with the principles of the present invention including an alternative pillbook.

Similar to the product package 700 described above with reference to FIGS. 18 and 19, the product package 800 depicted in FIGS. 20-23 is adapted to include six blister cards 812*a*-812*f*, each including five cells 880*a*-880*e* separated by perforated seams 882 and arranged in a single column. So configured, the pillbook 802 includes thirty cells 880 and thirty blisters 836 for accommodating product(s) 844, 846 (shown in FIG. 21A) for one or more thirty-day prescriptions, similar to the pillbook 700 described above with reference to FIGS. 18 and 19. Unlike the previous embodiment, however, each cell 880 includes a "pull tab" backing material 881 covering the back-side of the blisters 836, as depicted in FIGS. 20 and 21B. The "pull tab" backing material 881 can be adhered to the blister card 812 such that it can be peeled away from the back of the blister 836, thereby allowing a patient to gain access to the products 844, 846. In one embodiment, the "pull tab" backing material 881 can also be re-attached to the back-side of the blister 836 such as to reseal the blister 836. The "pull tab" backing material 881 can comprise a foil material, a plastic material, a paper material, or any other type of suitable material.

Figure 21A:
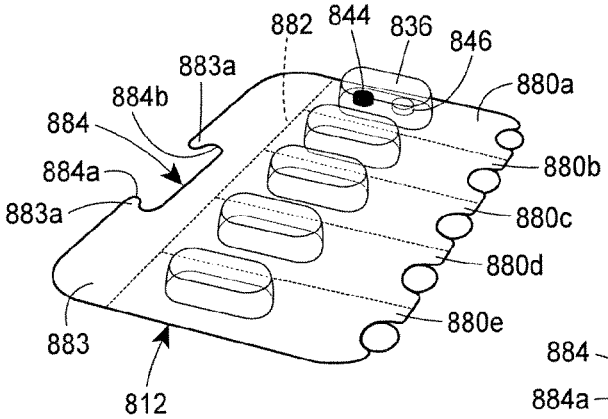
FIG. 21A is a perspective view of a front-side of a blister card of the product package of FIG. 20.
Figure 21B:
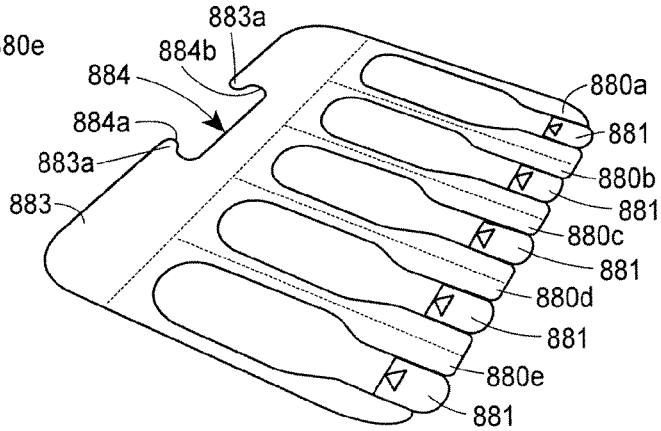
FIG. 21B is a perspective view of a back-side of a blister card of the product package of FIG. 20.

In addition to the cells 880, each blister card 812 of the present embodiment includes a hanger portion 883, as illustrated in FIGS. 20, 21A, and 21B. As depicted in FIG. 21A, for example, each hanger portion 883 defines a recess 884 for accommodating the coupler mechanism 806 and connecting the blister cards 812 into the binder 814. Each recess 884 includes a throat portion 884*a* and a mouth portion 884*b*. The throat portion 884*a* is narrower than the mouth portion 884*b* and is defined by a pair of arm portions 883*a* of the hanger portion 883.

Figure 22:
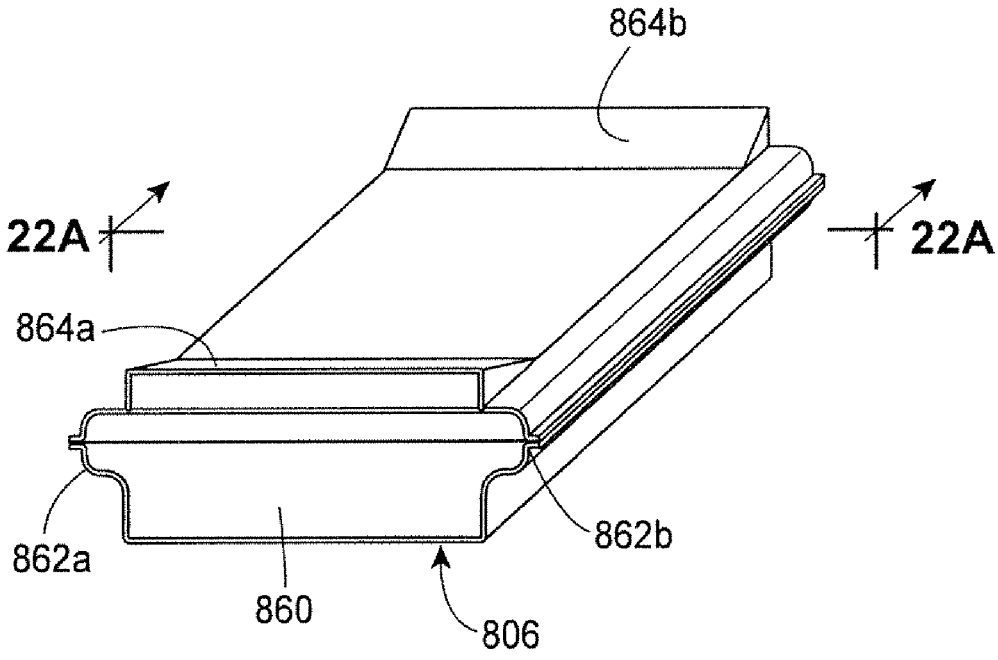
FIG. 22 is a perspective view of a coupler mechanism of the product package of FIG. 20.
Figure 22A:
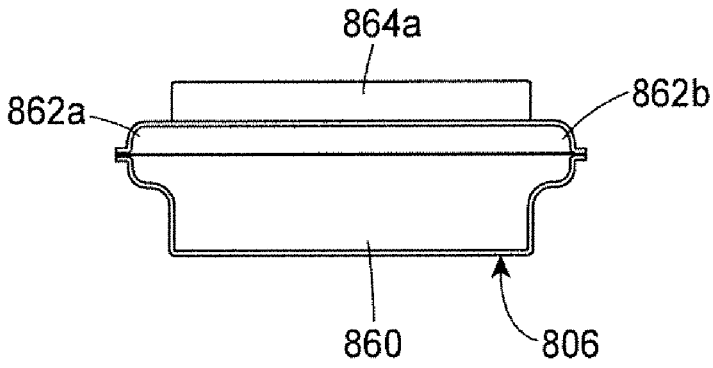
FIG. 22A is a cross-sectional view of the couple mechanism of FIG. 22 taken through line 22A-22A of FIG. 22.

Referring now to FIGS. 22 and 22A, the coupler mechanism 806 includes a generally elongated member attached to the spine 832 of the binder 814. More specifically, the coupler mechanism 806 includes a generally elongated base portion 860, an upper rib 862*a*, a lower rib 862*b*, and a pair of opposing end stops 864*a*, 864*b*. The base portion 860 comprises a generally rectangular box. The upper and lower ribs 862*a*, 862*b* extend along and protrude outward from the base portion 860. So configured, a cross-section of the coupler mechanism 806 taken through line 22A-22A in FIG. 22 is generally T-shaped, as illustrated in FIG. 22A. This T-shaped cross-section is sized and configured to fit within the recesses 884 formed in the hanger portions 883 of the blister cards 812. More specifically, the upper and lower ribs 862*a*, 862*b* are adapted to be disposed within the mouth portions 884*b* of the recesses 884 such that the arm portions 883*a* of the hanger portions 883 hook onto and engage the coupler mechanism 806, as illustrated in FIG. 20, for example.

In one embodiment, the coupler mechanism 806 can be constructed via thermoforming, for example, and of a resilient high density foam material. Such foam material would allow the hanger portions 883 of the blister cards 812 to "snap" onto, and off of, the coupler mechanism 806. For example, to remove a blister card 812 from the binder 814, a user can simply pull the blister card 812 away from the coupler mechanism 806 such that the arm portions 883*a* of the hanger portions 883 deform one or both of the upper and lower ribs 862*a*, 862*b*, thereby allowing the arm portions 883*a* to pass over the ribs 862*a*, 862*b* and off of the coupler mechanism 806. Once the blister card 812 is removed, the resilient foam material would return to its original shape. To replace the blister card 12 into the binder 814, the user can first hook one of the arm portions 883*a* of the hanger portion 883 of the blister card 812 onto the upper rib 862*a* of the coupler mechanism 806, for example. Then, the user can push the other end of the blister card 812 toward the coupler mechanism 806 such that the other arm portion 883*a* of the hanger portion 883 deforms the lower rib 862*b* and hooks onto the coupler mechanism 806. The lower rib 862*b* will then return to its original shape and the coupler mechanism 806 will retain the blister card 812 in the binder 814.

As mentioned above, the coupler mechanism 806 additionally includes the opposing end stops 864*a*, 864*b*. In the embodiment depicted in FIG. 22, the end stops 864*a*, 864*b* protrude away from the base portion 860 of the coupler mechanism 806 between the upper and lower ribs 862*a*, 862*b*. So configured, the end stops 864*a*, 864*b* prevent the blister cards 812 from sliding off of the ends of the coupler mechanism 806. In the disclosed embodiment, the end stops 864*a*, 864*b* have cross-sections shaped generally like right triangles and therefore are generally ramp-shaped. Alternative embodiments of the end stops 864*a*, 864*b*, however, may have generally any shape suitable for the intended purpose.

While the coupler mechanism 806 has been described as being constructed of a resilient foam material, alternative embodiments can be constructed of other resilient materials, or of non-resilient materials such as plastic, for example. In the case where the coupler mechanism 806 is constructed of a non-resilient material, the end stops 862*a*, 862*b* can be constructed to be removable from the base portion 860. So configured, to remove a blister card 812 from the binder 814, a user would first remove one of the end stops 864*a*, 864*b* from the base portion 860, and thereafter slide the desired one or more blister cards 812 off of the coupler mechanism 806.

Similarly, to replace a blister card 812, one of the end stops 864*a*, 864*b* would be removed from the base portion 860, and the user could slide the blister card 812 onto the coupler mechanism 806. Replacing the end stop 864*a*, 864*b* would then prevent the blister card 812 from sliding off of the coupler mechanism 806. In an alternative embodiment, instead of incorporating removable end stops 864*a*, 854*b*, the arm portions 868*a* of the hanger portions 883 of the blister cards 812 can be flexible. Such flexible arm portions 883*a* can therefore deform to pass over the rigid ribs 862*a*, 862*b*, and subsequently return to their original state to secure the blister cards 812 to the coupler mechanism 806.

While the pillbook 802 depicted in FIG. 20 has been described as including the coupler mechanism 806 as depicted in FIGS. 22 and 22A, alternative embodiments of the pillbook 802 can include alternative coupler mechanisms. For example, the coupler mechanism 806 can include hook and loop fasteners, ring binders, or any other type of coupler capable of allowing the blister cards 812 to be removed from, and re-attached to, the spine 832 of the binder 814.

As mentioned above, the blister cards 812 of the embodiment of the pillbook 802 depicted in FIG. 20 each include five cells 880*a*-880*e* arranged in a single column. The cells 880*a*-880*e* are separated from each other, as well as from the hanger portion 883, by the perforated seams 882. The blister cards 812 are identical to each other and the recesses 884 are positioned off-center. For example, as illustrated in FIG. 21A, when viewing the front-side of the blister card 812, which is the side that carries the blisters 836, the top of the recess 884 is positioned approximately even with the seam 882 that separates the second cell 880*b* from the third cell 880*c*, and the bottom of the recess 884 is positioned approximately within the center of the fourth cell 880*d*. So configured, the recess 884 is positioned "below center" when the blister card 812 is viewed from the front-side, as depicted in FIG. 21A. When the blister card 812 is flipped over, however, such that a viewer views the back-side of the blister card 812, the recess 884 is positioned "above center," as depicted in FIG. 21B.

Figure 23:
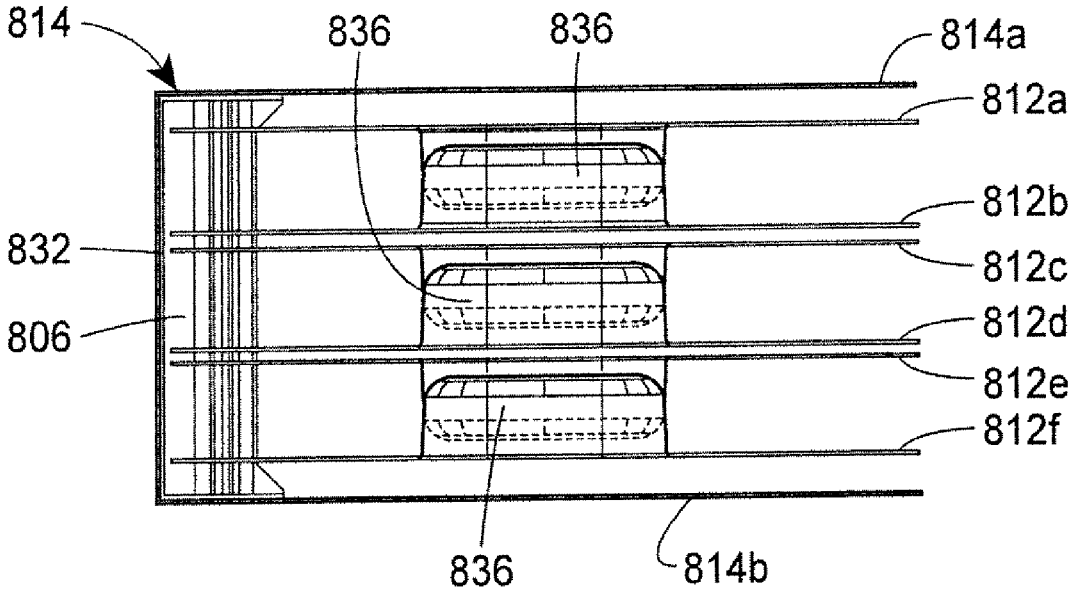
FIG. 23 is an end view of the product package of FIG. 20 including the pillbook in a closed configuration.

With the recesses 884 so positioned, the blister cards 812 can be oriented within the binder 814 in an alternating manner, as depicted in FIG. 23. Specifically, the front-sides of the second, fourth, and sixth blister cards 812*b*, 812*d*, and 812*f* face the front cover 814*a* of the binder 814, and the front-sides of the first, third, and fifth blister cards 812*a*, 812*c*, 812*e* face the back cover 814*b* of the binder 814.

So configured, the blisters 836 carried by the first cells 880*a* on the second, fourth, and sixth blister cards 812*b*, 812*d*, and 812*f* are nested within, or interleaved between, the blisters 836 carried by the first and second cells 880*a*, 880*b* of the first, third, and fifth blister cards 812*a*, 812*c*, and 812*e*, respectively. Moreover, the blisters 836 carried by the second cells 880*b* of the second, fourth, and sixth blister cards 812*b*, 812*d*, and 812*f* are nested within, or interleaved between, the blisters 836 carried by the second and third cells 880*b*, 880*c* of the first, third, and fifth blister cards 812*a*, 812*c*, and 812*e*, respectively. The blisters 836 carried by the third cells 880*c* of the second, fourth, and sixth blister cards 812*b*, 812*d*, and 812*f* are nested within, or interleaved between, the blisters 836 carried by the third and fourth cells 880*c*, 880*d* of the first, third, and fifth blister cards 812*a*, 812*c*, and 812*e*, respectively. Finally, the blisters 836 carried by the fourth cells 880*d* of the second, fourth, and sixth blister cards 812*b*, 812*d*, and 812*f* are nested within, or interleaved between, the blisters 836 carried by the fourth and fifth cells 880*d*, 880*e* of the first, third, and fifth blister cards 812*a*, 812*c*, and 812*e*, respectively.

So configured, the nesting, or interleaved, configuration minimizes the overall thickness of the pillbook 802 when it is closed. In one embodiment, the closed pillbook 802 can have a thickness of approximately 2.5", a height of approximately 8.25", and a width of approximately 4.75". While the pillbook 800 described with reference to FIGS. 20-23 includes six blister cards 812 for accommodating thirty blisters 836, each containing one or more medications to be ingested at a particular time of day for a complete thirty-day prescription, alternative embodiments can be adapted for different prescriptions.

Figure 24:
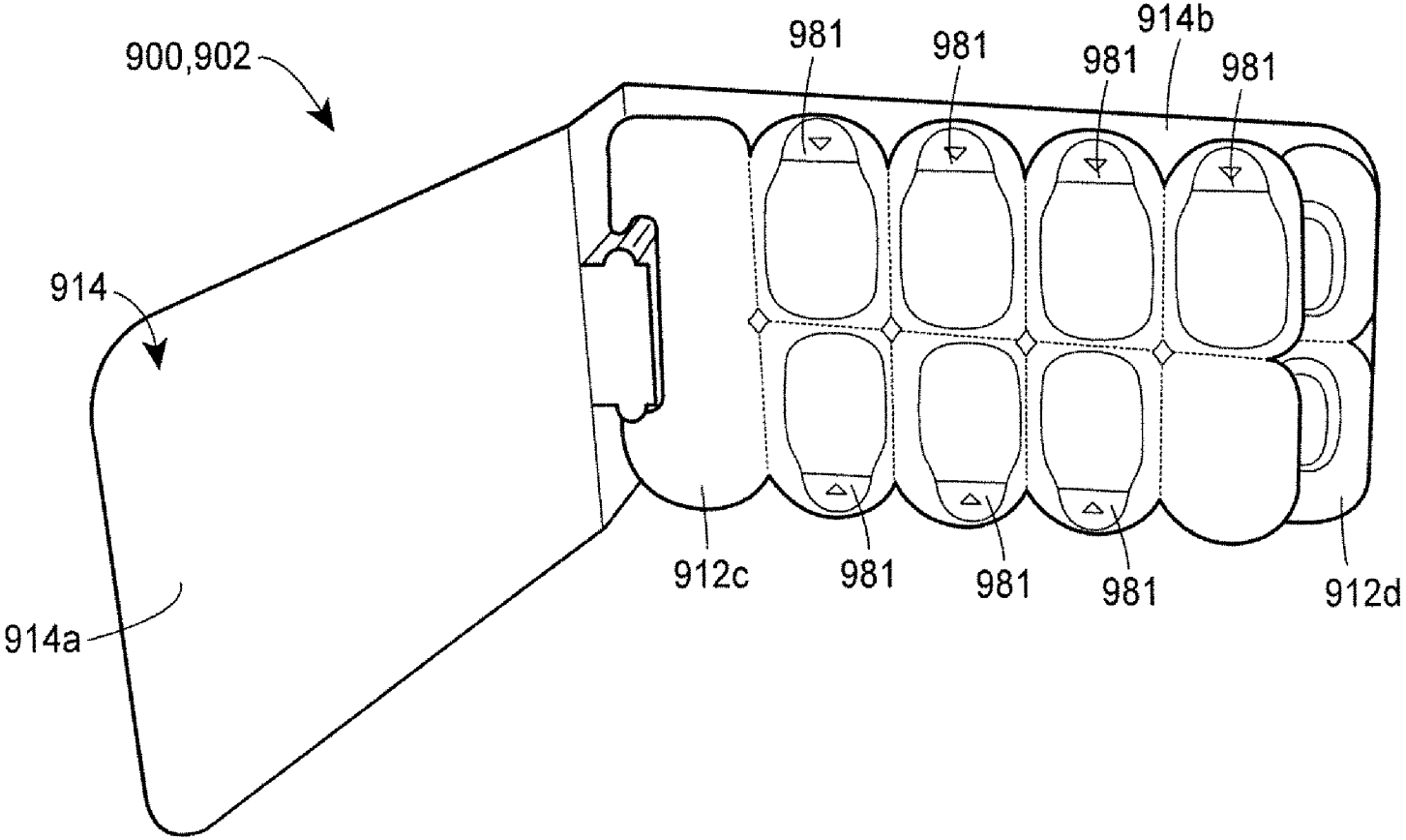
FIG. 24 is a perspective view of still another alternative embodiment of a product package constructed in accordance with the principles of the present invention including an alternative pillbook.
Figure 25A:
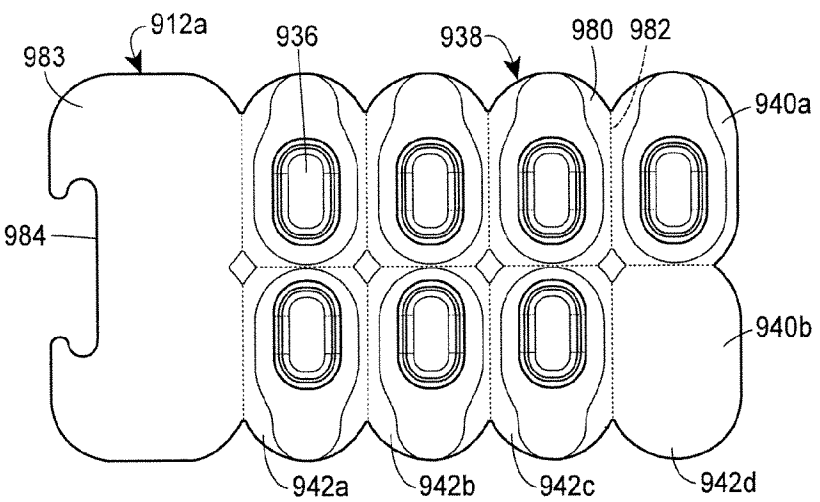
FIGS. 25A-25D are plan views of four blister cards of the product package of FIG. 24.
Figure 25B:
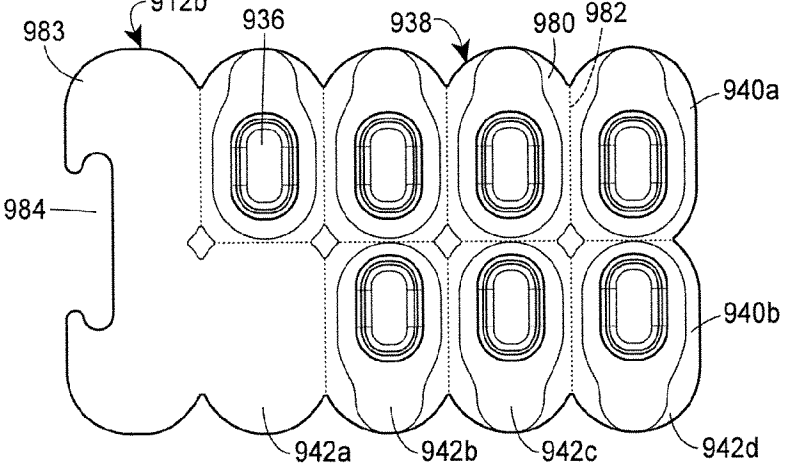
Figure 25C:
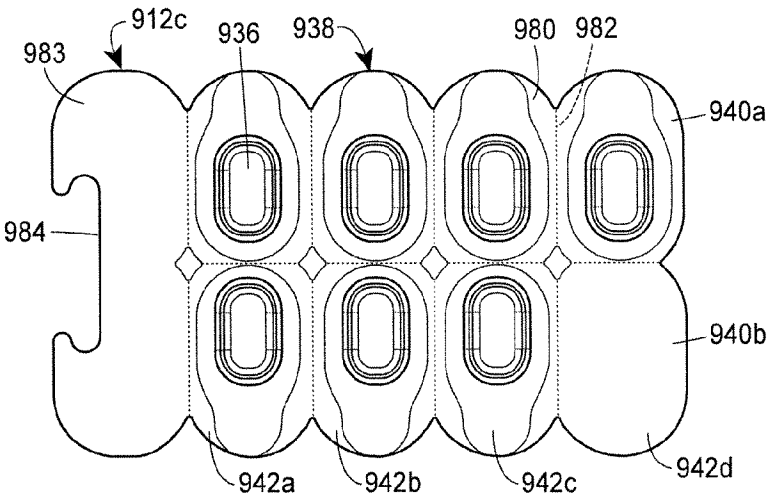
Figure 25D:
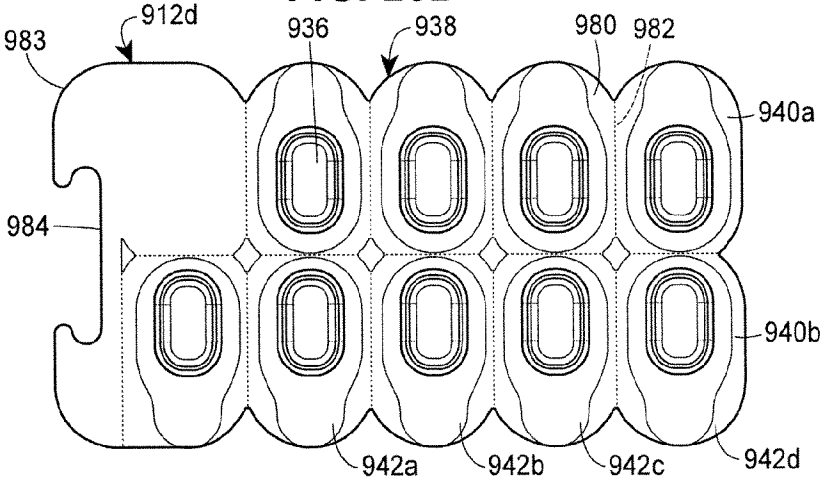
Figure 26:
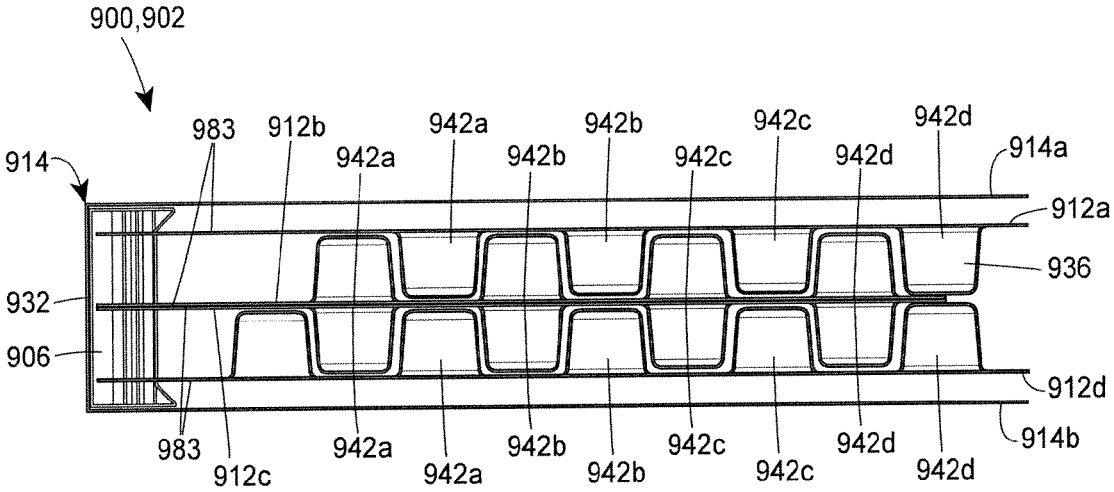
FIG. 26 is an end view of the product package of FIG. 24 including the pillbook in a closed position.

For example, FIGS. 24-26 depict another embodiment of a product package 900 of the present invention, which is constructed similar to the product package 800 described above in FIGS. 20-23, but has differently configured blister cards 912. Specifically, instead of having six blister cards 812*a*-812*f* for accommodating a thirty-day prescription, the product package 900 depicted in FIGS. 24-26 includes four blister cards 912*a*-912*d* for accommodating a thirty-day prescription, as will be described below. Otherwise, the product package 900 is similar to the product package 800 described above in that it includes a pillbook 902 comprising a binder 914 and the plurality of multi-dose blister cards 912*a*-912*d*. The binder 914 includes a front cover 914*a*, a back cover 914*b*, and a spine 932 (FIG. 26). The multi-dose blister cards 912*a*-912*d* are removably, and re-attachably, connected to the spine 932 of the binder 914 via a coupler mechanism 906 (FIG. 26). The coupler mechanism 906 can be identical to the coupler mechanism 806 described with reference to FIGS. 20-23. The coupler mechanism 906 can also include any alternative coupler mechanism suitable for serving the intended purpose.

Referring now to FIGS. 25A-25D, each of the blister cards 912*a*-912*d* are constructed generally similar to each other, and in a manner similar to any of the blister cards 12, 112, 212, 312, 412, 512, 612, 712, 812 described above. The first through third blister cards 912*a*-912*c* carry seven blisters 936, and the fourth blister card 912 carries nine blisters 936. Accordingly, the combination of the four blister cards 912-912*d* carry a total of thirty blisters 936. Each blister 936 is therefore adapted to accommodate one dose of one or more medications that a patient is prescribed to ingest each day, for an entire thirty-day prescription.

Each blister card 912*a*-912*d* includes a matrix 938 of cells 980. Each matrix 938 includes two rows 940*a*, 940*b* and four columns 942*a*-942*d*. In some embodiments, the cells 980 are separated by perforated seams 982. Each blister card 912*a*-912*d* additionally includes a hanger portion 983 that is disposed adjacent the first column 942*a* of cells 980. The hanger portion 983 of each blister card 912*a*-912*d* includes a recess 984 similar to the recesses 884 described above with reference to FIGS. 20-23. That is, the recesses 984 are defined by arm portions 983*a* of the hanger portions 983 to include a throat portion 984*a* and a mouth portion 984*b*. So configured, the recesses 948 are adapted to be repeatedly hooked onto, and off of, the coupler mechanism 906 in any manner similar to those described above with reference to FIGS. 20-23.

In the illustrated embodiment of the product package 900, each of the cells 980 of the first and third blister cards 912*a*, 912*c* carry a blister 936, except for the cell 980 located in the second row 940*b* of the fourth column 942*d*. Similarly, each of the cells 980 of the second blister card 912*b* carries a blister 936, except the cell 980 located in the second row 940*b* of the first column 942*a*. Finally, because the fourth blister card 912*d* of the currently illustrated embodiment carries nine blisters 936, each of its cells 980 carries a blister 936. Additionally, the hanger portion 983 of the fourth blister card 912*d* carries a blister 936. Similar to the blister cards 812 described above with reference to FIGS. 20-23, each cell 980 of the blister cards 912 of the present embodiment can include a "pull tab" backing material 981, as illustrated and described with reference to FIG. 19.

With reference to FIG. 26, the blister cards 912*a*-912*d* are adapted to be stored within the binder 914 of the product package 900 in a nested configuration, thereby reducing the overall size of the product package 900. Specifically, the blister cards 912*a*-912*d* are stored in the binder 914 in alternating orientations such that the blisters 936 of the third blister card 912*c* are nested within, or interleaved between, the blisters 936 of the fourth blister card 912*d*. Moreover, the second blister card 912*b* is oriented such that its back-side abuts against the back-side of the third blister card 912*c*, and the blisters 936 of the first blister card 912*a* are nested within, or interleaved between, the blisters 936 of the second blister card 912*b*. This particular nesting arrangement of the blisters 936 is made possible by the specific configuration of the blister cards 912*a*-912*d*.

For example, with reference back to FIGS. 25A-25D, the hanger portions 983 of the first and fourth blister cards 912*a*, 912*d* have width dimensions that are larger than the width dimensions of the hanger portions 983 of the second and third blister cards 912*b*, 912*c*. In the depicted embodiment, the hanger portions 983 of the first and fourth blister cards 912*a*, 912*d* are approximately fifty percent (50%) wider than the hanger portions 983 of the second and third blister cards 912*b*, 912*c*. So configured, when the blister cards 912*a*-912*d* are loaded into the binder 914, as depicted in FIG. 26, the first columns 942*a* of cells 980 on the first and fourth blister cards 912*a*, 912*d* are positioned farther away from the coupler mechanism 906 than the first columns 942*a* of cells 980 on the second and third blister cards 912*b*, 912*c*.

Accordingly, the blisters 936 carried by the first columns 942*a* of cells 980 on the first and fourth blister cards 912*a*, 912*d* are disposed between the blisters 936 carried by the first and second columns 942*a*, 942*b* of cells 980 of the second and third blister cards 912*b*, 912*c*. Additionally, the blisters 936 carried by the second columns 942*b* of cells 980 on the first and fourth blister cards 912*a*, 912*d* are disposed between the blisters 936 carried by the second and third columns 942*b*, 942*c* of cells 980 of the second and third blister cards 912*b*, 912*c*. Finally, the blisters 936 carried by the third columns 942*c* of cells 980 on the first and fourth blister cards 912*a*, 912*d* are disposed between the blisters 936 carried by the third and fourth columns 942*c*, 942*d* of cells 980 of the second and third blister cards 912*b*, 912*c*.

So configured, the blisters 936 are disposed in the aforementioned nesting, or interleaved, arrangement, which minimizes the overall thickness of the pillbook 902 when it is closed. In one embodiment, the closed pillbook 902 can have a thickness of approximately 1.9", a height of approximately 4.7", and a width of approximately 7.83".

As mentioned, with the blister cards 912*a*-912*d* so arranged, each blister 936 of the pillbook 900 is adapted to contain a dose of one or more prescriptions that a patient is prescribed to ingest on a particular day, and at a particular time of day. As such, the pillbook 902 can be considered a "Time of Day Pillbook." For example, each blister 936 of the pillbook 902 can contain a single dose of one or more medications, thereby containing a "multi-dose," which is to be taken in the morning, everyday, for thirty days. Should the patient also be prescribed another, and/or the same, medication(s) to be taken in the evening, everyday, for thirty days, the patient could be prescribed another pillbook 902. In the event the patient is prescribed multiple pillbooks 902, each pillbook 902 can be appropriately labeled, colored, or otherwise marked to identify the appropriate time of day, e.g., "AM", "PM," etc. in a manner similar to that described above with respect to the embodiments depicted in FIGS. 1-16.

While the product package 900 described with reference to FIGS. 24-26 includes four blister cards 912*a*-912*d* accommodating thirty blisters 936, each containing a single dose one or more medications, i.e., a multi-dose, to be ingested at a particular time of day, for example, for a complete thirty-day prescription, alternative embodiments can be adapted for different prescriptions.

For example, in one alternative embodiment, the product package 900 can comprise a "Weekly Pillbook," where the pillbook 902 contains four blister cards 912*a*-912*d*, and each blister card 912*a*-912*d* includes only seven blisters 936, one for each day of the week. With this configuration, the first through third blister cards 912*a*-912*c* can be identical to those depicted in FIGS. 25A-25C, but the fourth blister card 912*d* would resemble the first blister card 912*a* depicted in FIG. 25A. The first blister card 912*a* can store medications to be taken in the morning, for example, for the first seven days of a prescription. The second blister card 912*b* can store medications to be taken at lunch, for example, for the first seven days of the prescription. The third blister card 912*c* can store medications to be taken during the afternoon, for example, for the first seven days of the prescription. The fourth blister card 912*d* can store medications to be taken at night, for example, for the first seven days of the prescription.

The patient would then also be prescribed a second pillbook 902 for the second seven days of the prescription, a third pillbook 902 for the third seven days of a prescription, and a fourth pillbook 902 for the last nine days of the prescription.

In the fourth pillbook 902, each blister card 912*a*-912*d* would include nine blisters 936. Therefore, the first and fourth cards 912*a*, 912*d* would each resemble the fourth blister card 912*d* depicted in FIG. 25D. The second blister card 912*b* would resemble the second blister card 912*b* depicted in FIG. 25B, except that it would also include a blister 936 on the cell 980 located in the first column 942*a* of the second row 940*b*, and in the hanger portion 983, similar to that depicted in FIG. 25D. Finally, the third blister card 912*c* would resemble the third blister card 912*c* depicted in FIG. 25C, except that it would also include a blister 936 on the cell 980 located in the fourth column 942*d* of the second row 940*b*, as well as in the hanger portion 983, similar to that depicted in FIG. 25D.

While the multi-dose blister cards 712, 812, 912 and binders 714, 814, 914 of the pillbooks 700, 800, 900 depicted in FIGS. 18-26 are illustrated without any indicia or other information provided thereon, it should be appreciated that they can be provided with any of the indicia or other information described above with respect to the blister cards 12, 112, 212, 312, 412, 512, 612 depicted in FIGS. 1-16 including, for example, product information, patient information, time of day information, day of week information, re-order information, last dosage information, any of the other information described above, and/or any other information that may reasonably be provided. Moreover, the front and/or back covers 714*a*, 714*b*, 814*a*, 814*b*, 914*a*, 914*b* of the binders 714, 814, 914 can be provided with any of the identification information, graphics, and/or other indicia described above with respect to the product packages 10, 100, 200, 300, 400, 500, 600 depicted in FIGS. 1-16. Further still, it should be appreciated that the arrangement of the medication information, patient information, etc., provided on the product packages 700, 800, 900 can be customized by the patient in any of the manners described above with reference to the product packages 10, 100, 200, 300, 400, 500, 600 described above.

As mentioned above, the product packages 700, 800, 900 described with reference to FIGS. 18-26 can be arranged such that a patient may be prescribed more than one pillbook 802, 902. In such a case, the patient can also be provided a child-proof storage sleeve, box, or other container such as those depicted in FIGS. 3 and 4 of the present application. In one embodiment, the storage sleeve, box, or container can be generically adapted to contain four product packages 700, 800, 900, for example. If, however, a patient is only prescribed three product packages 700, 800, 900, for example, the patient can be provided with a spacer to reside in the location of the sleeve, box, or container where the fourth product package would otherwise reside.

Additionally, while the product packages 800, 900 depicted in FIGS. 18-26 have been described as accommodating thirty-day prescriptions, a person having ordinary skill in the art would appreciate that these are merely examples and that alternative embodiments can be arranged to accommodated twenty-eight day prescriptions, or any other prescriptions.

Moreover, while the blisters have been described herein as directly accommodating medications, for example, for ingestion by a user, alternative embodiments of the product packages 10, 100, 200, 300, 400, 500, 600, 700, 800, 900 can include mini-blisters (not shown) stored within the blisters 36, 136, 236, 336, 436, 536, 636, 736, 836, 936, wherein each mini-blister stores one or more of the products for ingestion by the patient. The mini-blisters can essentially include a miniature, single cell blister card, carrying a single blister that accommodates one or more prescriptions, for example. So configured, a patient can open the blister 36, 136, 236, 336, 436, 536, 636, 736, 836, 936 of the product package 10, 100, 200, 300, 400, 500, 600, 700, 800, 900 and remove the one or more mini-blisters to be carried away for subsequent ingestion of the product(s) stored therein. The mini-blisters can be shaped randomly, or can be shaped to fit together, for example, into pie-shaped pieces.

While the blisters 36, 136, 236, 336, 436, 536, 636, 736, 836, 936 described herein have been described as being accessible through a push-through backing material or via a "pull tab" backing material, alternative embodiments of the product packages 10, 100, 200, 300, 400, 500, 600, 700, 800, 900 can seal the blisters differently. For example, one product package 10, 100, 200, 300, 400, 500, 600, 700, 800, 900 can be opened with a single "pull tab" backing material that provides access to two or more of the blisters 36, 136, 236, 336, 436, 536, 636, 736, 836 simultaneously. Additionally, in one embodiment including the "pull tab" backing material, the individual cells 80, 180, 280, 380, 480, 580, 680, 780, 880 980 of the blister cards 12, 112, 212, 312, 412, 512, 612, 712, 812, 912 can include recesses, or counter cuts along the side edges thereof, thereby providing the patient an easier grip on the "pull tab" backing material. Alternatively, the "pull tab" backing material 881, 981 can overhang the side of the individual cell 80, 180, 280, 380, 480, 580, 680, 780, 880 980, as depicted in FIG. 20, for example, to provide the patient with an easily graspable portion. Still another alternative embodiment of the "pull tab" backing material 881, 981 can include a plastic strip laminated to the end of the pull tab, which provides the patient an area to easily grasp.

In another embodiment of a product package constructed in accordance with the present invention, the blisters 36, 136, 236, 336, 436, 536, 636, 736, 836, 936 that are equipped with push-through backing material can include a paperboard backing material adhered to the push-through backing material and defining a "trap door" backing layer. Such "trap door" backing layer can include perforated pull tabs disposed adjacent to each blister 36, 136, 236, 336, 436, 536, 636, 736, 836, 936, which the patient would be required to first peel prior to pushing the medication through the backing material. Such an arrangement can provide a level of protection against unwanted tampering or child access to the blisters 36, 136, 236, 336, 436, 536, 636, 736, 836, 936.

In still another embodiment, each blister card 12, 112, 212, 312, 412, 512, 612, 712, 812, 912 can be equipped with a sliding mechanism such that each side of the blister cards are covered by a sliding paperboard material. The paperboard material can have openings adapted for alignment with the blisters. To access any given blister 36, 136, 236, 336, 436, 536, 636, 736, 836, 936, a patient must first slide the paperboard or the blister card relative to the other and align the blisters with the openings. With the blisters aligned with the openings, the products may be pushed out, or the pull tabs may be peeled. Such an arrangement can provide a level of protection against unwanted tampering or child access.

Finally, while the blister cards have been described herein as comprising a plurality of cells separated by perforated seams, in some alternative embodiments, the perforated seams may be constructed of differing levels of perforation depending on their specific location within the blister card. Moreover, in one embodiment, the patient may even be able to customize his/her prescribed blister card(s) to include levels of perforation that reflect his/her preferences. For example, in the embodiment of the product package 900 wherein each blister card 912*a*-912*d* contains medications for a specific time of day, a patient may choose to only have the "afternoon" blister card perforated because he/she takes all the other medications at home. This way, the cells on the "afternoon" blister card can be torn from the remainder of the card and taken to work, for example. In another alternative embodiment, the same patient may choose to have all the blister cards perforated, but have the cells of the "afternoon" blister card perforated to a level that makes the tearing of these cells easier than the cells of the other blister cards.

It is also possible that when patients or caregivers order customized cards without any perforations, the spacing between the blisters may be reduced to further reduce the overall sizes of the blister cards. It is further possible that the patients or caregivers may order blister cards with blisters corresponding to ingestion of pills at certain times of the day rearranged in any fashion that is convenient and preferred by the patient or caregiver.

In light of the foregoing, it should be appreciated that the product packages described herein are prone to a multitude of variations and customizations by and for the patient, thereby providing a highly versatile and desirable product package.

What is claimed is:

1. A product package comprising:

a spine;

a plurality of blister cards, each blister card comprising a plurality of individual cells, each individual cell comprising a blister for containing at least one product; and a coupler mechanism attached to the spine and re-attachably coupling the plurality of blister cards within the product package, wherein the coupler mechanism comprises an elongated member attached to the spine and each of the plurality of blister cards comprises a recess receiving the elongated member, the recess in each blister card being positioned off-center of the blister card such that the blister cards are re-attachably connected to the elongated member in an alternating offset orientation wherein each blister card is offset relative to an adjacent blister card in a direction perpendicular to a longitudinal dimension of the elongated member.

2. The package of claim 1, further comprising:

upper and lower ribs disposed on the elongated member; and a pair of arm portions defined by each of the plurality of blister cards, the arm portions extending into the recess and hooking onto the upper and lower ribs to re-attachably couple the plurality of blister cards to the coupler mechanism.

3. The package of claim 2, wherein the upper and lower ribs on the elongate member are constructed of a more resilient material and the arm portions are constructed of a less resilient material.

4. The package of claim 3, wherein the more resilient material comprises a resilient foam material.

5. The package of claim 2, wherein the upper and lower ribs on the elongate member are constructed of a less resilient material and the arm portions are constructed of a more resilient material.

6. The package of claim 1, further comprising a pair of opposing end stops disposed on the elongated member for preventing the plurality of blister cards from sliding off of the coupler mechanism.

7. The package of claim 6, wherein the pair of opposing end stops are removably disposed on the elongated member.

8. The package of claim 1, wherein the plurality of blister cards comprises a first blister card and a second blister card, the first blister card comprising a first plurality of blisters that are nested with a second plurality of blisters of the second blister card when the first and second blister cards are coupled into the product package via the coupler mechanism.

9. The package of claim 1, further comprising front and back covers hingedly coupled to the spine.

10. The package of claim 1, wherein each of the individual cells of the plurality of blister cards are separated by perforated seams.

11. The package of claim 10, wherein each of the plurality of blister cards comprises a plurality of openings, each opening disposed between at least two individual cells for facilitating removal of each individual cell from the respective blister card.

12. The package of claim 1, further comprising identification information disposed on each of the individual cells of each blister card, the identification information indicating to a user when to ingest the product stored within the blister associated with the respective individual cell.

13. The package of claim 1, further comprising identification indicia disposed on the spine, the identification indicia indicating to a user when to ingest the product stored within the blisters of the plurality of blister cards coupled within the product package.

14. The package of claim 1, further comprising a child-proof sleeve removably accommodating the spine, the plurality of blister cards, and the coupler mechanism.

15. A package system comprising:

a first product package comprising a first elongated spine and a first plurality of blister cards, each blister card including a plurality of individual cells and a corresponding plurality of blisters, the first plurality of blister cards being re-attachably coupled to the first elongated spine, wherein the first plurality of blister cards are coupled to the first elongated spine in an alternating offset orientation such that each blister card is offset relative to an adjacent blister card in a direction perpendicular to a longitudinal dimension of the first elongated spine; and a second product package comprising a second elongated spine and a second plurality of blister cards, each blister card including a plurality of individual cells and a corresponding plurality of blisters, the second plurality of blister cards being re-attachably coupled to the second elongated spine, wherein the second plurality of blister cards are coupled to the second elongated spine in an alternating offset orientation such that each blister card is offset relative to an adjacent blister card in a direction perpendicular to a longitudinal dimension of the second elongated spine.

16. The system of claim 15, further comprising a child-proof sleeve accommodating the first and second product packages such that the first and second product packages can be independently removed from and inserted into the child-proof sleeve.

17. The system of claim 15, further comprising a first coupler mechanism disposed between the first spine and each of the first plurality of blister cards, and a second coupler mechanism disposed between the second spine and each of the second plurality of blister cards.

18. The system of claim 17, wherein the first and second coupler mechanisms each comprises an elongated member attached to the respective spines and each of the blister cards comprises a recess receiving the respective elongated member.

19. The system of claim 18, further comprising:

upper and lower ribs disposed on the elongated member; and a pair of arm portions defined by each of the blister cards of the first and second pluralities of blister cards, the arm portions extending into the respective recesses and hooking onto the upper and lower ribs to re-attachably couple the blister cards to the respective coupler mechanisms.

20. The system of claim 19, wherein the upper and lower ribs on the elongate members are constructed of a more resilient material and the arm portions are constructed of a less resilient material.

21. The system of claim 20, wherein the more resilient material comprises a resilient foam material.

22. The system of claim 19, wherein the upper and lower ribs on the elongate members are constructed of a less resilient material and the arm portions are constructed of a more resilient material.

23. The system of claim 18, wherein the first and second coupler mechanisms each further comprise a pair of opposing end stops disposed on the elongated members for preventing the plurality of blister cards from sliding off of the coupling mechanisms.

24. The system of claim 23, wherein the pair of opposing end stops are removably disposed on the elongated members.

25. The system of claim 15, wherein the first and second pluralities of blister cards each comprises a first blister card and a second blister card, the first blister card comprising a first plurality of blisters that are nested with a second plurality of blisters of the second blister card.

26. The system of claim 15, wherein the first and second product packages each further comprises front and back covers hingedly coupled to the respective first and second spines.

27. A package system, comprising:

a first product package, comprising:

a first elongated spine, a first plurality of blister cards, each blister card of the first plurality of blister cards comprising a plurality of individual cells, each individual cell comprising a blister for containing at least one product, and a first coupler mechanism attached to the first elongated spine and re-attachably coupling the first plurality of blister cards to the first elongated spine in an alternating offset orientation such that each blister card is offset relative to an adjacent blister card in a direction perpendicular to a longitudinal dimension of the first elongated spine and the blisters of each blister card of the first plurality of blister cards are nested within the blisters of an adjacent blister card of the first plurality of blister cards;

a second product package, comprising:

a second elongated spine, a second plurality of blister cards, each blister card of the second plurality of blister cards comprising a plurality of individual cells, each individual cell comprising a blister for containing at least one product, and a second coupler mechanism attached to the second elongated spine and re-attachably coupling the second plurality of blister cards including the corresponding individual cells and blisters to the second elongated spine in an alternating offset orientation such that each blister card is offset relative to an adjacent blister card in a direction perpendicular to a longitudinal dimension of the second elongated spine and the blisters of each blister card of the second plurality of blister cards are nested within the blisters of an adjacent blister card of the second plurality of blister cards; and a child-proof sleeve accommodating the first and second product packages such that the first and second product packages can be independently removed from and inserted into the child-proof sleeve.

28. The system of claim 18, wherein the recess in each blister card of the first and second pluralities of blister cards is positioned off-center of the blister card.

29. The system of claim 27, wherein the first and second coupler mechanisms re-attachably couple each of the first and second pluralities of blister cards to the first and second spines, respectively, via a recess formed in each blister card at a position off-center of the blister card.

* * * * *